US006964321B2

(12) United States Patent
Baughman, III et al.

(10) Patent No.: US 6,964,321 B2
(45) Date of Patent: Nov. 15, 2005

(54) METHOD AND SYSTEM FOR PRESENTING MERCHANDISE AT AN OUTDOOR PAVED SURFACE

(75) Inventors: George Washington Baughman, III, Worthington, OH (US); William Anthony Dascenzo, Sarasota, FL (US); Kristin Elizabeth Griffin, Marysville, OH (US); Larry L. Wood, Columbus, OH (US)

(73) Assignee: Outdoor Merchandising Solutions, LLC, Sarasota, FL (US)

( * ) Notice: Subject to any disclaimer, the term of this patent is extended or adjusted under 35 U.S.C. 154(b) by 423 days.

(21) Appl. No.: 09/955,417

(22) Filed: Sep. 18, 2001

(65) Prior Publication Data

US 2003/0051749 A1 Mar. 20, 2003

(51) Int. Cl.[7] ..... E04H 1/12; E04H 1/06

(52) U.S. Cl. ..... 186/52; 186/36; 52/174; 40/602; 40/606.01; 40/607.01; 135/87

(58) Field of Search ..... 52/174, 169.2, 52/750; 135/87, 96; 434/72; 186/52, 36; 40/602, 605, 606, 607

(56) References Cited

U.S. PATENT DOCUMENTS

| | | | | | |
|---|---|---|---|---|---|
| 1,242,429 | A | * | 10/1917 | Enochty | 40/602 |
| 1,242,872 | A | * | 10/1917 | Saunders | 186/36 |
| 1,404,613 | A | * | 1/1922 | Hormes | 52/174 |
| 1,483,067 | A | * | 2/1924 | Berry | 40/602 |
| 1,494,390 | A | * | 5/1924 | Stevenson | 186/53 |
| 1,821,541 | A | * | 9/1931 | Brown | 186/36 |
| 2,018,945 | A | * | 10/1935 | Castner | 135/87 |
| 2,193,747 | A | * | 3/1940 | Thompson | 40/607 |
| 2,638,635 | A | * | 5/1953 | Priebe | 186/36 |
| 2,638,636 | A | * | 5/1953 | Pool | 186/52 |
| 3,370,369 | A | * | 2/1968 | Look | 40/605 |
| 3,436,879 | A | * | 4/1969 | Duke | 52/174 |
| 3,437,177 | A | * | 4/1969 | Close | 186/52 |
| 3,471,153 | A | * | 10/1969 | Baumler | 273/359 |
| 3,660,832 | A | * | 5/1972 | Hoshall | 340/280 |
| 3,673,720 | A | * | 7/1972 | Thornton | 40/125 R |
| 3,777,428 | A | * | 12/1973 | Caufield | 52/146 |
| 3,940,139 | A | * | 2/1976 | Barnes | 473/494 |
| 3,982,758 | A | * | 9/1976 | Howes, Jr. | 273/29 R |
| 4,001,987 | A | * | 1/1977 | Coulthard | 52/79.9 |
| 4,172,334 | A | * | 10/1979 | Nielsen | 40/607 |
| 4,642,946 | A | * | 2/1987 | Koch | 52/38 |

(Continued)

FOREIGN PATENT DOCUMENTS

| | | | | |
|---|---|---|---|---|
| EP | 1202201 | * | 2/2002 | 186/52 |
| JP | 263533 | * | 10/1993 | 135/96 |

OTHER PUBLICATIONS www.slockerkrecorder.org/countyco "22.08.144 Sales lots and swap meets" pp. 1–2.* www.sloclerkrecorder.org/countyco "22.08.142 outdoor retail sales" pp. 1–2.* www.sjfm.com/1.html "flea market slide show" p. 1.* www.accessduarte.com/communitydevelopment/permit-s.asp "our kind of town" pp. 1–3.*

*Primary Examiner*—Phi Dieu Tran A
(74) *Attorney, Agent, or Firm*—Mueller and Smith, LPA

(57) ABSTRACT

A method and system for presenting merchandise on a paved surface which employs permanently installed anchors each having a vertical sleeve. Poles of common height are inserted within the sleeves of the anchors in a manner defining a three dimensional merchandising region. The tops of the poles are interconnected by tensioned cable assemblies from which informational signage is suspended and retained by lower disposed retainer tensioned cables. Merchandising bays are established between mutually adjacent poles and entrance and exit regions are established in conjunction with a shopper aisle. A canopy is supported by poles and anchors over a cash/wrap station at the exit region.

26 Claims, 12 Drawing Sheets

U.S. PATENT DOCUMENTS 4,735,290 A * 4/1988 Byrley ..... 186/52
4,830,382 A * 5/1989 Wheeler ..... 473/492
4,901,482 A * 2/1990 Lockard et al. ..... 52/33
5,042,183 A * 8/1991 Kennedy ..... 40/607
5,120,941 A * 6/1992 Reilley et al. ..... 235/375
5,158,155 A * 10/1992 Domain et al. ..... 186/53
5,168,961 A * 12/1992 Schneider ..... 186/52
5,172,505 A * 12/1992 Borsella ..... 40/606
5,299,781 A * 4/1994 Barrett et al. ..... 256/12.5
5,333,880 A * 8/1994 Allbright ..... 473/493
5,470,185 A * 11/1995 Tsubota et al. ..... 414/264
5,595,263 A * 1/1997 Pignataro ..... 186/53
5,617,661 A * 4/1997 Mason ..... 40/642.01
5,700,102 A * 12/1997 Feleppa ..... 403/170
5,937,883 A * 8/1999 Camara ..... 135/87
6,089,995 A * 7/2000 Schroeder ..... 473/469
6,148,551 A * 11/2000 Glass ..... 40/214
6,257,418 B1 * 7/2001 Allen et al. ..... 211/1.3
6,276,083 B1 * 8/2001 Ross ..... 40/607
6,279,855 B1 * 8/2001 Domer ..... 244/114 R
2002/0100197 A1 * 8/2002 Perry ..... 40/606
2002/0138367 A1 * 9/2002 Meurer ..... 705/27

* cited by examiner

FIG. 14
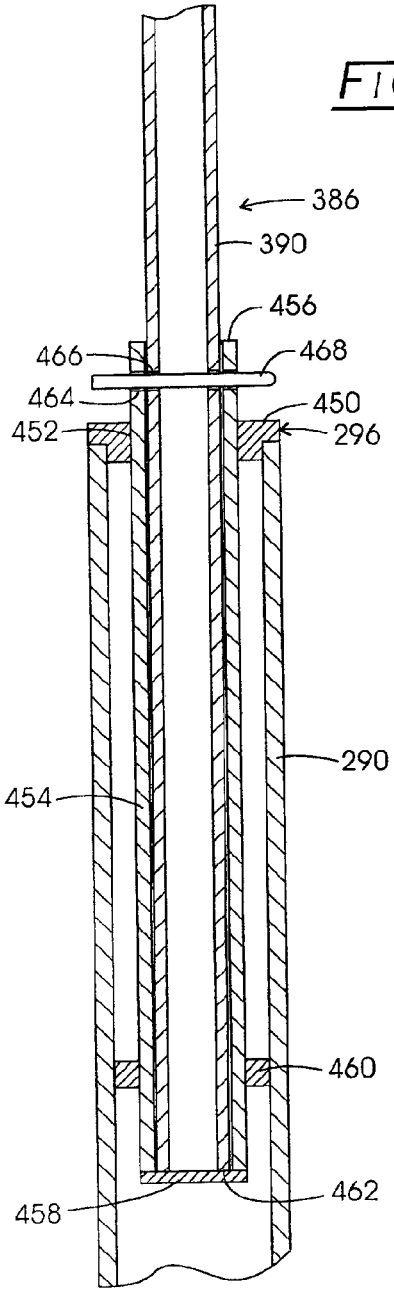
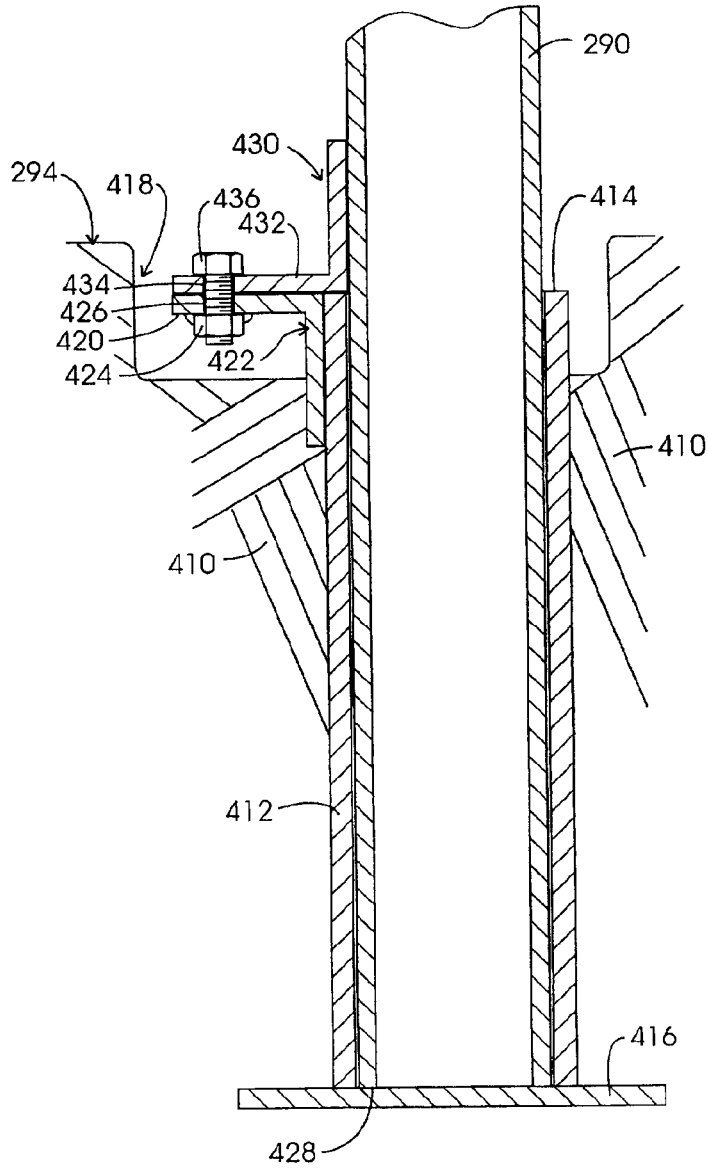
FIG. 11

METHOD AND SYSTEM FOR PRESENTING MERCHANDISE AT AN OUTDOOR PAVED SURFACE

CROSS-REFERENCE TO RELATED APPLICATIONS

STATEMENT REGARDING FEDERALLY SPONSORED RESEARCH

Not applicable.

BACKGROUND OF THE INVENTION

The marketing and merchandising of lawn and garden products is, for the most part, a seasonal endeavor. However, notwithstanding the seasonal aspect, the National Gardening Association has reported that the total value of the do-it-yourself gardening and landscaping business in the United States (1999–2000) amounted to about $33.5 billion. 67 million U.S. households have at least one member involved in these endeavors. With respect to lawn care alone, there are about 25 million acres of green lawn in the United States.

The approach traditionally taken by retailers in selling rain proof varieties of these lawn and garden products has been to disburse piled or palletized merchandise in parking lots adjacent the store facility. Product arrangement generally is haphazard and signage so marginal that the resultant point-of-sale and its retail function are generally unrecognized by potential new shoppers. Very often the only signage utilized has only identified price. For example, so called portable "shovel signs" often are simply placed upon the top bag of a palletized assemblage of bagged product such as fertilizer. Occasionally, merchants will rent large tents to draw shoppers. However, such tents carry no signage effective to draw the attention of the shopper and, importantly, are considered by many retailers to exhibit a prohibitive cost/benefit ratio. Typical outdoor merchandising can create, in effect, an intimidating environment. Pallet borne products can be mistaken by shoppers as a product staging area rather than an actual retail-ready space.

This typical parking lot merchandising format, in effect, represents a retailing anomaly. In this regard, successful retailers have long studied and continue to study all aspects of store functional design, signage and decor to maximize merchandise sales and company profits.

> That means that while branding and traditional advertising build brand awareness and purchase predisposition, those factors do not always translate into sales. The standard tools of marketing work, they just don't work anywhere near as well as they used to. Many purchasing decisions are made, or can be heavily influenced, on the floor of the store itself. Shoppers are susceptible to impressions and information they acquire in stores, rather than just relying on brand-name loyalty or advertising to tell them what to buy.

> As a result, an important medium for transmitting messages and closing sales is now the store and the aisle. That building, that place, has become a great big three-dimensional advertisement for itself. Signage, shelf position, display space and special fixtures all make it either likelier or less likely that a shopper will buy a particular item (or any item at all). The science of shopping is meant to tell us how to make use of all those tools. How to design signs that shoppers will actually read and how to make sure each message is in the appropriate place. How to fashion displays that shoppers can examine comfortably and easily. How to ensure that shoppers can reach, and want to reach, every part of a store. It's a very long list—enough to fill a book in my opinion.

Underhill, "Why We Buy, The Science Of Shopping", Simon & Schuster, 1999, pp 32–33

Sales of lawn and garden products in the ubiquitous parking lot of store facilities should be within a retail environment tailored to the science of shopping. Thus, the point-of-sale, albeit in a parking lot, must be amenable to characteristics of the shopper. The signage should be discernible at a distance and convey information which in the present retailing era will not be available from the diminishing number of sales clerks.

> The first principle behind the science of shopping is the simplest one: There are certain physical and anatomical abilities, tendencies, limitations and needs common to all people, and the retail environment must be tailored to these characteristics.

Underhill (Supra) p43

> I'm talking about the absolute basics here, such as the fact that we have only two hands, and that at rest they are situated approximately three feet off the floor. Or that our eyes focus on what is directly before us but also take in a periphery whose size is determined in part by environmental factors, and that we'd rather look at people than objects. Or that it is possible to anticipate and even determine how and where people will walk—that we go in predictable paths and speed up, slow down and stop in response to our surroundings.

> The implications of all this are clear: Where shoppers go, what they see, and how they respond determine the very nature of their shopping experience. They will either see merchandise and signs clearly or they won't. They will reach objects easily or with difficulty. They will move through areas at a leisurely pace or swiftly—or not at all. And all of these physiological and anatomical factors come into play simultaneously, forming a complex matrix of behaviors which must be understood if the retail environment is to adapt itself successfully to the animal that shops.

Underhill (Supra) pp 43–44

The parking lot itself traditionally has been considered a detriment to the fostering of sales. Such parking lots typically involve exhaust fumes, automobiles being poorly driven, debris strewed about and they typically exude the environment of a vast stretch of asphalt. Thus, shoppers tend to walk quickly to the adjacent store in order to rid themselves of an unpleasant environment with all dispatch. Accordingly, savvy retailers adjust store entrance features to accommodate this faster paced customer entry into a retail store.

> Bear in mind, too, that the faster people walk, the narrower their field of peripheral vision becomes. But by the time we get close enough to see the goods or read the signs, we're in no mood to stop and look. We've got that good cardiovascular parking-lot stride going, and it's bringing us right into the entrance. So forget whatever it is those windows are meant to accomplish—when they face a parking lot, if the message in them isn't big and bold and short and simple, it's wasted.

Underhill (Supra) p 46

> These people are not truly in the store yet. You can see them, but it'll be a few seconds more before they're actually here. If you watch long enough you'll be able to predict exactly where most shoppers slow down and make the transition from being outside to being inside. It's at just about the same place for everybody, depending on the layout of the front of the store.

All of which means that whatever's in the zone they cross before making that transition is pretty much lost on them. If there's a display of merchandise, they're not going to take it in. If there's a sign, they'll probably be moving too fast to absorb what it says. If the sales staff hits them with a hearty "Can I help you?" the answer's going to be, "No, thanks," I guarantee it. Put a pile of fliers or a stack of shopping baskets just inside the door. Shoppers will barely see them, and will almost never pick them up. Move them ten feet in and the fliers and baskets will disappear. It's a law of nature—shoppers need a landing strip.

Underhill (Supra) pp 46–47

To gain new customers from what generally is considered a fixed customer base, the merchandise presented at the retail facility and identified with its associated signage should be recognizable to potentially new shoppers from substantial distances away. Typical parking lot based lawn and garden sales regions have no characteristics lending to their identification from a distance nor establishing their mercantile function.

We'll start by standing at the proper vantage point for evaluating any retail environment: half a block away. That's where the first issue arises—we can't see the place. We can see the building just fine, but there's no big sign or giant book or anything else to tell us we're so close to a bookstore. Now, its regular customers know where it is. But who knows how many others find themselves standing on this very spot, heads swiveling, trying to figure out where exactly the store is located. What's more, every day there are people walking down this street who might impulsively decide to drop in, but not if they don't know it's there.

Underhill (Supra) p 225

The haphazard nature of the parking lot sales endeavor is additionally manifested by an essential random location of its cash/wrap area. This defect perhaps is a given consequence of the unstructured, loosely planned nature of these retail endeavors.

We spent a lot of time that weekend watching people in line to pay at what the retail industry calls cash/wraps. Regardless of what store designers and merchandise managers think, in many ways the cash/wrap area is the most important part of any store. If the transactions aren't crisp, if the organization isn't clear at a glance, shoppers get frustrated or turned off. Many times they won't even enter a store if the line to pay looks long or chaotic.

Underhill (Supra) p 26

BRIEF SUMMARY OF THE INVENTION

The present invention is addressed to a method and system for presenting merchandise at an outdoor paved surface which, on a highly practical basis, achieves the formation of a three dimensional merchandising region. The system is desirably modular and may be erected and disassembled by store personnel.

Employing a permanent grid of in-ground anchors, each supporting an insertion sleeve and adjusted for pavement elevation variations, poles of a common height are erected by slidably inserting them within the sleeves of selected anchors. The selection of the anchors within which to insert a pole is one which establishes the geometric boundaries of the merchandising region, providing for a defined entrance, a defined exit and a shopper aisleway extending from the entrance to the exit and passing in adjacency with a cash/wrap station located next to the exit region. Along the sides of the merchandising region, the poles are spaced apart a bay distance, for example, ten feet. The tops of the poles, which typically extend about ten feet from the pavement surface, are selectively interconnected by a horizontally disposed signage support. Those signage supports are removably coupled to permanent eyelets fixed to the tops of the poles. To facilitate ease of erection and disassembly, the signage support assemblies are each formed with flexible steel cable, a connected turnbuckle and snap clips which are connected by store personnel to the eyelets, whereupon the cable is tensioned. Merchandising bays thus are established between adjacent poles. Those merchandising bays are further identified by flexible signage suspended from the tensioned cables by simple snap-on connectors such that they extend a common distance to a lower sign border.

To stabilize the signs, which typically are formed from thin plastic sheet materials, a lower set of eyelets is fixed to each pole just below the horizontal border of a suspended sign. A lower sign retainer assemblage structured identically to the upper signage support assemblies then is coupled between these lower disposed eyelets. By connecting the lower borders of the signs to the sign retainer assemblies with simple, breakaway connectors, the signs are protected from excessive wind loading and, afforded a rigidity contributing to the three dimensional aspect of the merchandising region.

With the arrangement, the signage is supported upwardly along an optimized shopper visualization region located at a bay access elevation above the pavement surface. The latter elevation permits the loading of palletized merchandise from the side of the merchandising region boundary. With the arrangement, a prospective shopper is given a remote visual identification of the merchandising function at hand and then is presented with a defined entrance and shopper aisle leading to a defined exit region. Visual emphasis is given the important cash/wrap region through the utilization of an overhead fabric canopy supported by poles inserted within the sleeves of permanent anchors.

To promote remote shopper visualization, flag assemblies are removably insertable at the top of each pole and, where local topography restricts remote shopper viewing, anchors are located to support poles of enhanced elevation which, utilizing the same form of removable sign supports now suspend and retain elongate vertical banners.

As another object, the invention provides a method for presenting merchandise at an outdoor paved surface which comprises the steps of:

defining a retail geometric boundary at the paved surface;

providing a plurality of anchors about the boundary, each extending below the surface of the pavement and mutually spaced apart to establish bay distances, each anchor having a vertically disposed sleeve having a support distance located below the paved surface;

providing a plurality of first poles, each having an insertion end configured for slidable insertion to the extent of the support distance within a sleeve and extensible, when inserted within a sleeve, an overhead signage sight height from the pavement surface to a top;

positioning the first poles within the anchor stage to define a retail floor pattern having an entrance region and a shopper aisle extending therefrom to a shopper exit region;

interconnecting a pole top with a next adjacent pole top with a horizontally disposed signage support to define a three dimensional retailing region with a select number of merchandising bays extending between adjacent poles from the geometric boundary to the shopper aisle;

suspending merchandise information signage from the signage support at the boundary along the bay;

the signage extending downwardly from the signage support within a shopper line of sight region to a lower border adjacent a bay access elevation above the pavement surface;

positioning the merchandise within the bay below the bay access elevation and locating the merchandise correspondence with the merchandise information signage; and providing a cash/wrap region adjacent the shopper aisle.

Other objects of the invention will, in part, be obvious and will, in part, appear hereinafter.

The invention, accordingly, comprises the method and system possessing the construction, combination of elements, arrangement of parts and steps which are exemplified in the following detailed description.

For a fuller understanding of the nature and objects of the invention, reference should be made to the following detailed description taken in connection with the accompanying drawings.

BRIEF DESCRIPTION OF THE DRAWINGS

FIG. 11 is a partial sectional view taken through the plane 11—11 shown in FIG. 10;

FIG. 14 is a partial sectional view taken through the plane 14—14 shown in FIG. 10;

DETAILED DESCRIPTION OF THE INVENTION

The merchandising method and system of the invention involves a highly modularized assembly of relatively tall poles. They are removably supported by subsurface anchors which are permanent and preferably laid out in a grid within a paved area. These poles and relatively highly elevated signage supported by them cooperate to define or create an image of a three dimensional retailing or merchandising corral or region. This region or at least retail function defining portions of it is structured to be visible to prospective shoppers from a distance, for example, one half block away. The system defines an entrance and an exit extending at opposite sides of a shopper aisle or corridor within which the shopper may "land" after exiting an automobile and walking along, for example, a paved parking lot. Preferably the trade dress of the elevated signage emulates the established trade dress of the retailer both in terms of color and design. Additionally, the artwork of the signage employed to identify the product and explain it may emulate the trade dress of the brand of merchandise to which it pertains. Important cash/wrap locations preferably are perceptually enhanced with an overhead canopy located adjacent the exit region of the merchandising region.

Figure 1:
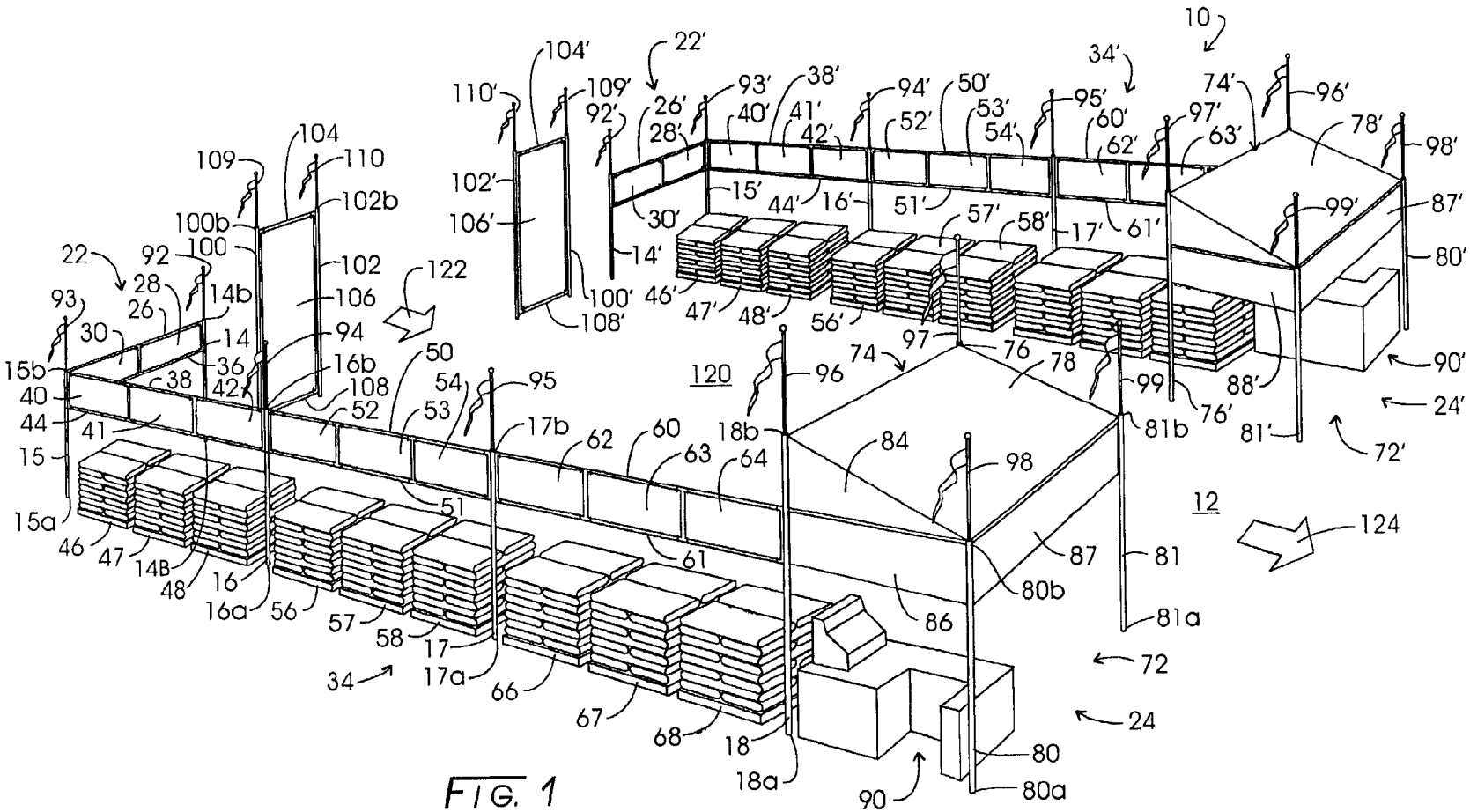
FIG. 1 is a perspective view of an outdoor merchandising region configured for carrying out the method of the invention.

Referring to FIG. 1, components supporting the system and method at hand are represented generally at 10 as they are modularly mounted upon an outdoor paved surface, i.e., a parking lot represented generally at 12. Region 10 is configured exhibiting a generally rectangular three dimensional space emulating the inside of a retail store. Permanently formed within the pavement 10 and extending below the surface 12 are plurality of anchors, preferably arranged in a grid, which support a plurality of mutually spaced apart elongate poles which are arranged in the grid to develop the merchandising region. For the demonstration of FIG. 1, poles as identified at 14–20 form one side of the rectangular merchandising region, 10, establishing a right side front region represented generally at 22 and right side exit region represented generally at 24. In this regard, the right side front region 22 is, inter alia, established with poles 14 and 15 which extend above the pavement surface 12, a distance selected to establish an overhead signage sight height. Poles 14 and 15 extend from the top regions of their sleeve containing anchors adjacent pavement surface 12 as represented respectively at 14*a* and 15*a* to a top shown respectively at 14*b* and 15*b*. Interconnecting the region adjacent pole tops 14*b* and 15*b* is a horizontally disposed upper signage support which, preferably, is provided as incorporating a tensioned cable 26. Merchandise information signage as represented at signs 28 and 30 is suspended from the tensioned cable 26 so as to provide information to a shopper inter alia, confirming that the system 10 is a retail establishment. The signs 28 and 30 additionally are attached to a lower horizontal signage support or retainer provided as incorporating a tensioned cable 32. Preferably, the outwardly facing components of the signs 28 and 30 will identify the nature of the merchandise within the system 10 as well as the retailer.

Pole 15 in conjunction with poles 16–19 establish a right side region of the retailing geometric boundary as represented generally at 34. Poles 15 through 18 are mutually spaced apart a bay distance, for example, ten feet and extend as at 16*a*–18*a* from the surface 12 to tops shown respectively at 16*b*–18*b*.

To establish a three dimensional visual aspect to the shopper, a horizontally disposed signage support provided as incorporating a tensioned cable 38 extends between pole top 15*b* and pole top 16*b* and from that cable 38, merchandise information signage is suspended as represented at signs 40–42. Signs 40–42 are supported against wind induced movement by virtue of their connection with a lower disposed horizontal retainer incorporating cable 44 which also is in tension.

Signs 40–42 and associated lower support cable 44 are vertically positioned above the pavement surface 12 so as to be optimally perceptible to shoppers as consequence of peripheral vision and direct confronting vision. The inwardly facing signage surfaces will contain both merchandise identifying information and that helpful form of information which shoppers will want to know concerning the use of the product. Lower support cable 44 also is located at a bay access elevation above pavement surface 12 which is effective to permit stocking and restocking access to merchandise, for example, of the lawn and garden variety which typically is palletized and maneuvered using fork lift trucks. For example, the access elevation will be about eight feet such that the height of the suspended signs themselves will be about two feet. The palletized sacked merchandise extending inwardly from the merchandising bay represented between poles 15 and 16 as shown at 46–48. Note that a sign as at 40–42 is dimensioned so as to be aligned with and carry information specific to the respective palletized merchandise 46–48.

In accordance with the modular aspect of the instant method and system, the number of such merchandising bays is established based upon the requirements of the retailer. For the instant demonstration, three merchandising bays are linearly arranged along the boundary at right side region 34. In this regard, the horizontal support incorporating tensioned cable 50 extends between pole tops 16*b* and 17*b* and corresponding lower support or retainer incorporating tensioned cable 51 extends to support signs 52–54 above respective palletized merchandise items 56–58. Note that the upper sign support incorporating cable 50 is in substantial vertical alignment with the upper support incorporating cable 38 as is the lower retainer incorporating cable 51 with the retainer incorporating lower cable 44. As before, the inwardly facing surfaces of signs 52–54 carry product identifying information as well as that form of information helpful to the shopper as to the use or character of the merchandise. Depending upon the contractual relationship between the retailer and the merchandise supply wholesaler, the information carried by these signs, particularly as inwardly displayed also may carry brand identification and trade dress associated with the trade dress of the palletized merchandise immediately below the signage. A third merchandising bay is seen extending between poles 17 and 18. As before, this merchandising bay is configured with upper supports and lower retainers incorporating tensioned cables 60 and 61. Signs as at 62–64 are supported from the upper support incorporating cable 60 and secured to the lower support or retainer incorporating cable 61. The sign suspending support incorporating cable 60 is seen to be vertically aligned with those supports incorporating upper cables 50 and 38 and is seen to be secured to pole 18 at an elevation above pavement surface 12 corresponding with pole top 17*b* which is located below pole top 18*b*. While the height above surface 12 of the poles as at 14–17 is ten feet, the corresponding height of pole 18 is about twelve feet. Each of the signs 60–64 is associated with respective palletized merchandise 66–68.

Right side region 34 concludes at the right side rear or exit region 24 with a cash/wrap station represented generally at 72. Station 72 is perceptually identified to the shopper as well as protected by a waterproof material implemented overhead canopy represented generally at 74.

In general, canopy 74 is configured with waterproof fabric or the like connected with a rigid metal support structure. The latter support structure is configured with two elongate poles, one of which is seen at 18 and the top of the other is seen at 76. Poles 18 and 76 provide the upper elevation, i.e. twelve feet above surface 12 for developing the ridge of a sloping waterproof fabric roof surface 78 which extends to the tops 80*b* and 81*b* of respective poles 80 and 81. Other canopy geometries may be employed with the methodology. For example, a purely rectangular, as opposed to triangular shape has been successfully tested. Poles 80 and 81 extend from surface 12 at 80*a* and 81*a* and have a height corresponding with the height of poles 14–17, i.e., ten feet. Outwardly disposed waterproof material upward triangular side panels are provided at each side of the canopy 74 one of which is seen at 84 and lower waterproof fabric side panels are provided around three sides of the structure, which are seen at 86–88. Canopy 74 is seen to extend over a cash/wrap station counter and cash register represented generally at 90.

The provision of canopy structures with the cash/wrap stations provides a visual guide to the stations. Once the shopper selects merchandise for purchase, there remains no confusion as to where the subsequent sale is to be consummated.

> We spent a lot of time that weekend watching people in line to pay at what the retail industry calls cash/wraps. Regardless of what store designers and merchandise managers think, in many ways the cash/wrap area is the most important part of any store. If the transactions aren't crisp, if the organization isn't clear at a glance, shoppers get frustrated or turned off. Many times they won't even enter a store if the line to pay looks long or chaotic.

Underhill (supra) at p 26

To enhance remote visualization of the merchandising region 10, flag assemblies are removably attached to the tops of each of the poles, the flags of these assemblies being shown in the form of triangular pennants. Also, rectangular flags are appropriate for this perception enhancing feature. Flag assemblies 92–96 are seen attached to the tops of respective poles 14–18, while flag assemblies 97–99 are positioned to extend from the tops of respective poles 76, 80 and 81.

Figure 4:
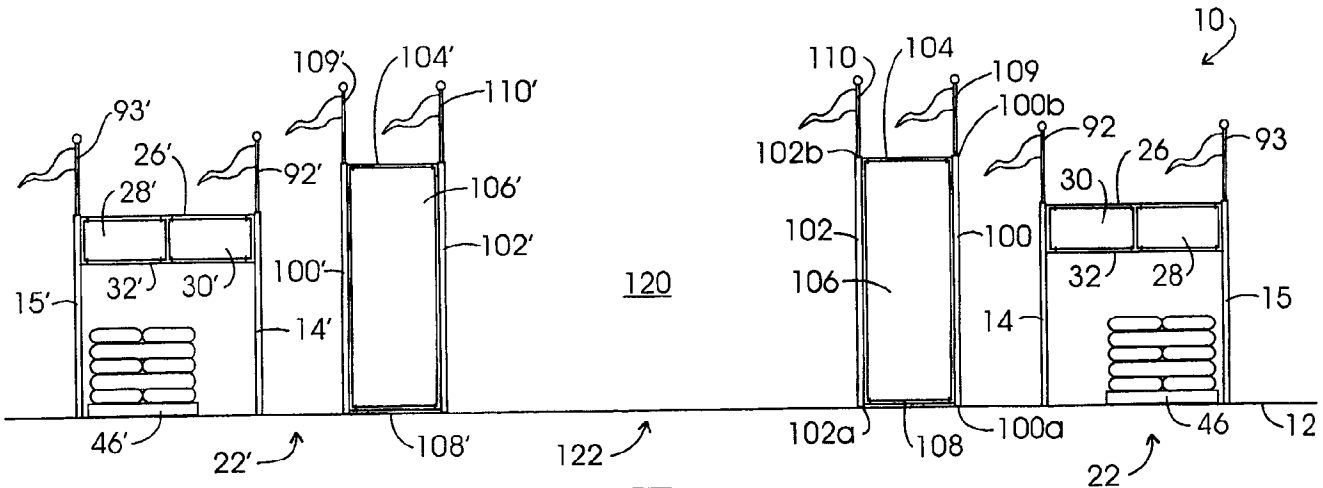
FIG. 4 is a front view of the merchandising region of FIG. 1.

Merchandising systems as at region 10 may be positioned upon surfaces 12 which are located within a topographical region making remote visualization by prospective shoppers more difficult to achieve because of blocked vision. Signage to attain such remote shopper attention in such regions can be provided adjunctly to system 10 utilizing the modular larger poles as at 18 and 76 to support tall, banner-like signage, for example, reaching to pole tops at twelve feet above the surface 12. Such elevated signage is shown in the figure in conjunction with paired poles 100 and 102. As seen in FIG. 4, these poles extend respectively from the surface at locations 100*a* and 102*a* to pole tops 100*b* and 102*b*. As before, a horizontally disposed signage suspending support

104 extends between the pole tops 100*b* and 102*b* which, in turn, supports a thin sign 106. Support 104 can be implemented with a tensioned cable. To support the lower edge of sign 106, a similar tensioned cable implemented support is shown at 108 extending adjacent the surface 12. To further enhance the visualization impact on the shopper, flag assemblies 109 and 110 extend from respective pole tops 100*b* and 102*b*.

Note that the spacing between tall poles 100 and 102 is less than the bay width provided, for example, between poles 15 and 16. This follows from both the merchandising region remote shopper identification function of these signs, as well as the substantial wind loads which may be encountered in view of their larger surface area. A width of, for example, four feet has been employed for the banners as at 106 and 106'. Signs as at 106 may be formed, for example, from a fiber reinforced vinyl which is horizontally hemmed and connected with grommets and snap-on connectors, certain of which are described in connection with FIGS. 16 and 17. Sign 106 also may incorporate wind slits.

The three dimensional retailing space aspect of the region 10 and the formation of a highly important retailing shopper aisle is derived through the locating of an opposite side construct along boundary of the merchandising region 10. For region 10, that opposite side is a mirror image of the right side region 34, right side front region 22 and right side exit region 24. Accordingly, the left side front or entry region and left side exit region are identified with the same numeration but in primed fashion. With these oppositely disposed retailing side regions, a shopper aisle is developed as is represented generally at 120 and as seen additionally in FIGS. 4 and 5. Shopper aisle 120 extends between a defined retail entrance represented at arrow 122 and a defined retail exit represented at arrow 124. The width of this shopper aisle 120 may be varied in view of the geometric modularity of pole placement establishing the region 10 boundaries and, for the heavy palletized merchandise illustrated in the instant figures, may be made of a width of about ten feet to accommodate vehicle traffic for loading purposes. However, retailers may wish to avoid the presence of those vehicles within the shopper aisle 120 to negate a parking lot atmosphere and that aisle narrowing is accommodated for by boundary adjustment and/or merchandise positioning.

Figure 2:
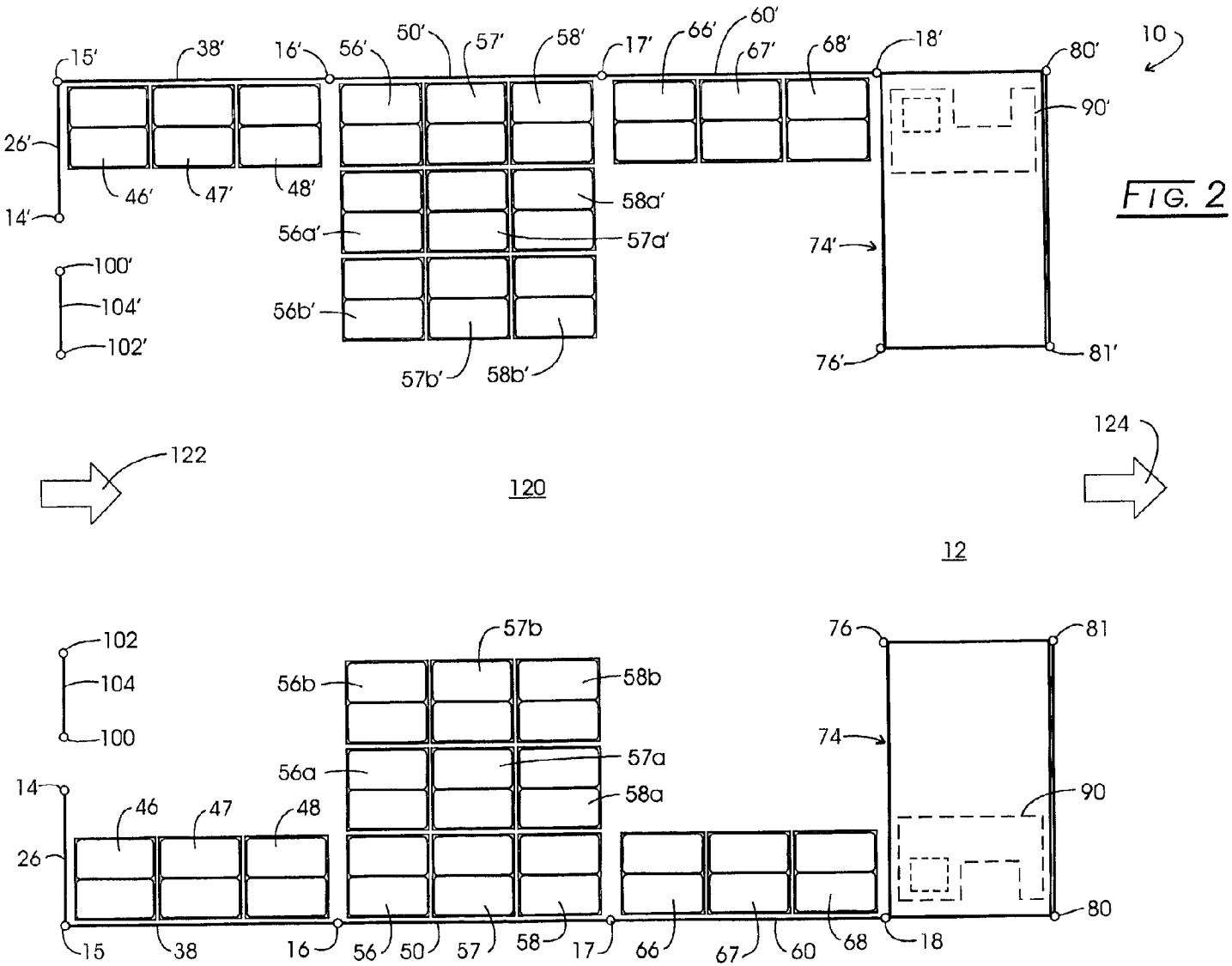
FIG. 2 is a top view of the region shown in FIG. 1 with alterations in the positioning of merchandise being shown.

Looking additionally to FIG. 2, a top view of region 10 is presented showing the entrance at 122, shoppers aisle 120 and exit at 124. In the figure, the merchandising bay between poles 16 and 17 as well as between poles 16' and 17' have been stocked with additional palletized merchandise as represented respectively at 56*a*–58*a*, 56*b*–58*b* with respect to the bay between poles 16 and 17 and, correspondingly, at 56*a*'–58*a*' and 56*b*'–58*b*' with respect to the merchandising bay extant between poles 16' and 17'. Shoppers entering the aisle 120 will proceed along a more narrowly defined aisle width. For purposes of informational visualization, however, the signs as described in connection with FIG. 1 at 52–54 or at 52'–54' are at a readily perceived shopper line of sight, whether the shopper is observing peripherally while walking along aisle 120 or directly confronting such signage.

Figure 3:
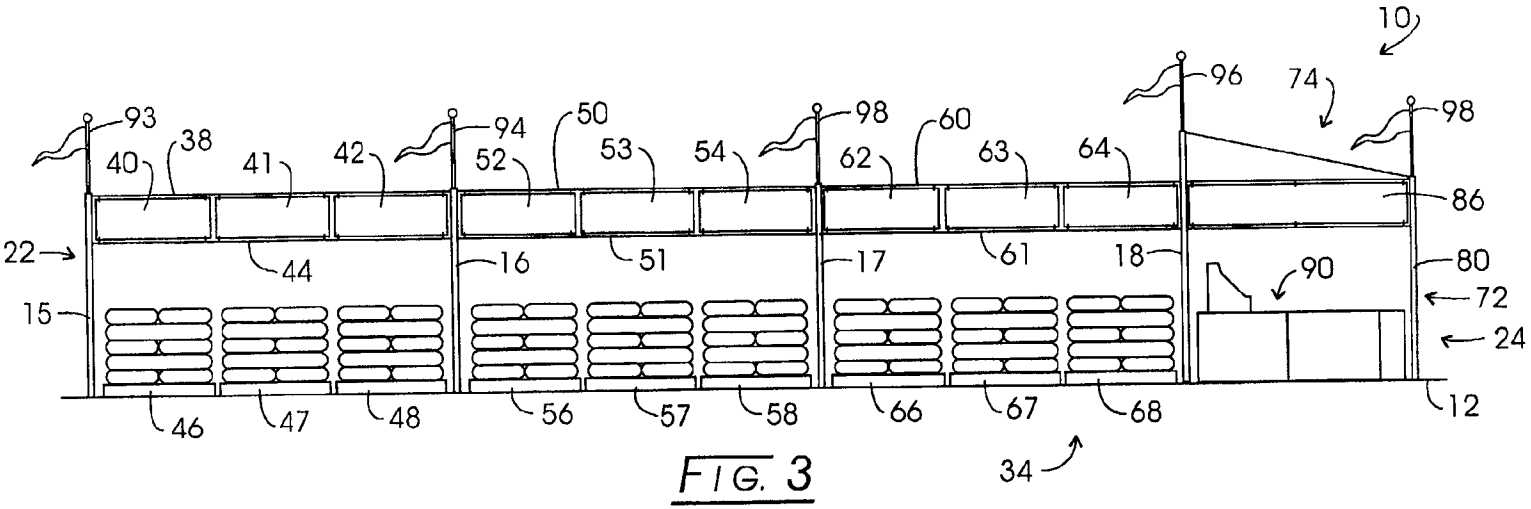
FIG. 3 is a side view of the merchandising region of FIG. 1.

External or remote shopper visualization of the merchandising region 10 is quite important with respect of the subject matter of the science of shopping. FIG. 3 reveals a shopper visualization of the side 34 of the region 10. Note that the pole supported signage is at an elevation which readily is perceived. The flag assemblies 93–98 are perception stimulators, in effect, leading the shoppers' sight lines to the information provided at the overhead signage as at 40–42, 52–54 and 62–64. Further, the important location of the cash/wrap station 72 is visually enhanced by the canopy structure 74. The figure also makes apparent that the bay access elevation, for example, between surface 12 and lower cable implemented supports 44, 51 and 61 is such that palleted merchandise can be stocked using forklift devices from the exterior of the boundary of the system region 10.

FIG. 4 reveals the important three dimensional defining imagery of the right side front region 22 and left side region 22' as they establish the entrance 122 and shopper aisle 120. As before, the overhead signage established between poles 14 and 15 and 14' and 15' is at an elevation, for example, between eight feet and ten feet which is readily perceived by the approaching shopper and visual stimulation prompting the shopper to look toward that signage is provided by the flag assemblies 92–93 and 92'–93'. As noted above, for some topographies, the elevationally extended signage provided with poles 100–102 and 100'–102' becomes quite valuable. The flag assemblies 108 and 110 and 108' and 110' function, as before, as a visual guide to the signage just below it.

Figure 5:
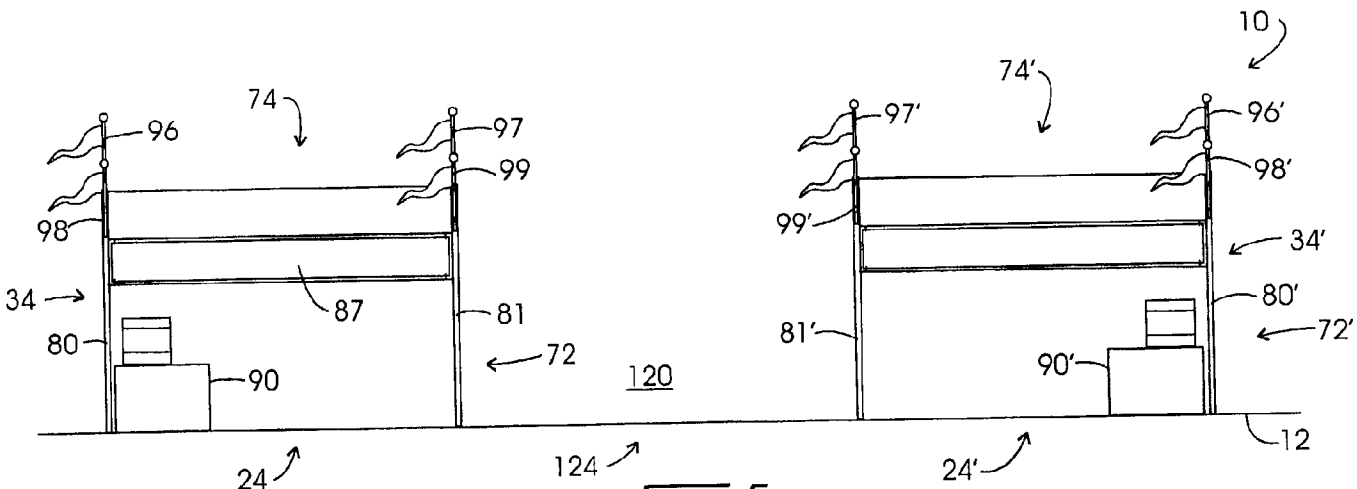
FIG. 5 is a rear view of the merchandising region of FIG. 1.

FIG. 5 reveals the shoppers' remote visualization of the right and left exit regions 24 and 24'. Canopies 74 and 74' readily establish the aisle 120 and, in association with flag assemblies 96–99 and 96'–99' essentially invite and guide the shopper to return. Signage may be provided at 87 and 87' which, again is at an optimum shopper line of sight region. Very often, shoppers will return or be drawn to the merchandising region 10 and, thus, the remote exit image is also quite important.

Where the paved surface supporting the merchandising system region 10 is, for example, at a entrance to the principal or supporting retail facility then the merchandising system region 10 and associated shopper aisle 120 can be employed to initially condition the shopper prior to entrance into the main retail facility. As noted above, shoppers entering a retailing building from a parking lot typically require some form of transition zone before they will wish to make a purchase or observe displays unless those displays are sufficiently visually profound. The modularity of the instant system permits its positioning to establish a necessary transition zone.

> I'd love to see someone try this out-of-the-box strategy: Instead of pulling back from the entrance, push the store out beyond it—start the selling space out in the parking lot. After all, football fans make elaborate use of parking lots in even the worst weather, barbecuing and eating and drinking and socializing on asphalt. Drive-in movies everywhere are turned over to flea markets during daylight hours, proof that people will comfortably shop al fresco. Some supermarkets will bring seasonal merchandise out into the parking lot during summer; I visited one in a seashore resort that had all barbecue supplies, beach toys, suntan lotion and rubber sandals in a tent outfitted with a clerk and a cash register—allowing beachgoers to pull up, grab a few necessities and drive away, all without having to drag their sandy selves through the food aisles and long checkout lines. Pushing the store outside also begins to address an interesting situation in America—the fact that so much of the country has been turned into parking lots. Buildings can be put to a variety of uses—a clothing store can sell electronics or groceries or even be converted into office space. But our vast plains of asphalt will require more imaginative thinking.

Underwood (supra) pp 49–50.

Figure 7:
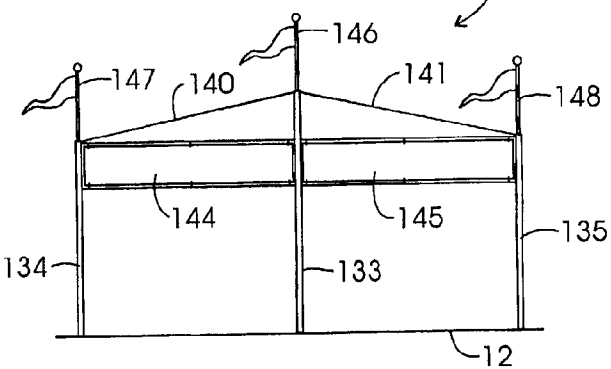
FIG. 7 is a side view of the canopy of FIG. 6.
Figure 6:
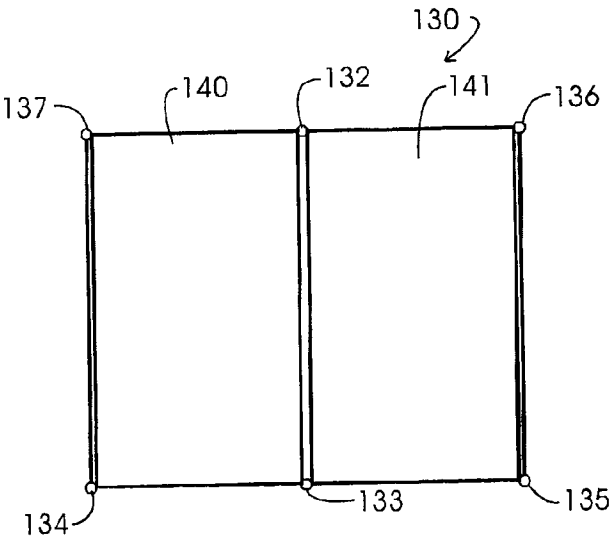
FIG. 6 is a top view of a dual canopy structure which may be employed with the method of the invention.

The modularity of the merchandising system also extends to the overhead canopy as at 34. Looking to FIGS. 6 and 7, two such canopies are, in effect, abuttably joined together to form a single canopy 130 having a footprint doubling the size of canopy 34 over the surface 12. Such enlargement may be employed to protect merchandise which may be sun sensitive or where a more product function specific sales region is desired. FIG. 6 is a top view of canopy 130 which is formed with two poles of extended elevation, for example, twelve feet above surface 12 as shown at 132 and 133 in conjunction with four standard poles, for example, extending ten feet above surface 12 as shown at 134–137. A waterproof fabric top extends over the assemblage as shown by the two slanting components 140 and 141. As shown in FIG. 7, the canopy 130 may incorporate signage, as before, extending downwardly from the tops of poles 134–137. Two of such side panels which may carry signage are shown in FIG. 7 at 144 and 145. Note additionally, that flag assemblies may be provided at the tops of all the poles 132–137. Three such flag assemblies are shown in FIG. 7 at 146–148 as extending from the tops of respective poles 133–135.

Figure 8:
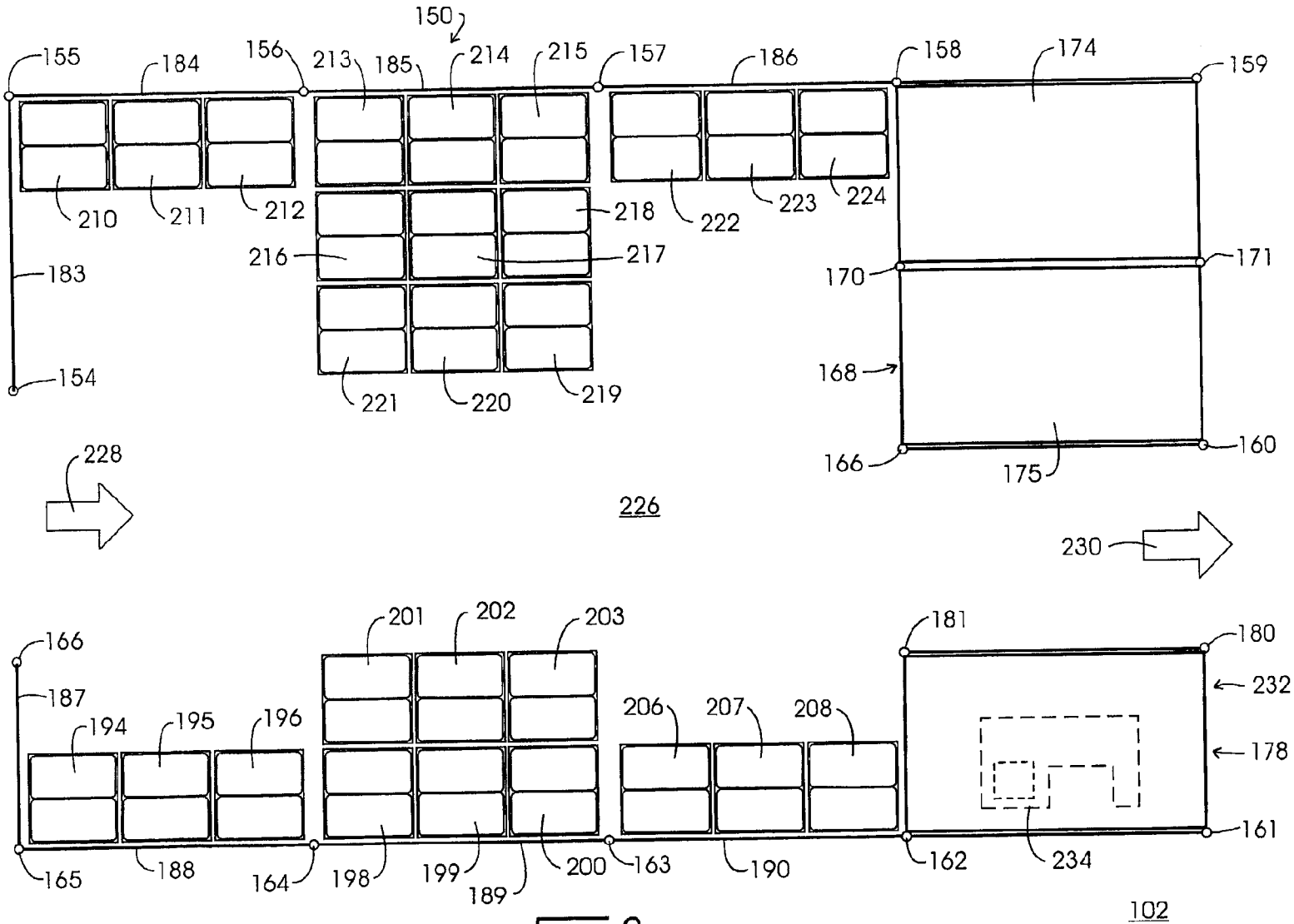
FIG. 8 is a top view of another merchandising region layout for practicing the method of the invention.

Referring to FIG. 8, the geometric boundary representing another merchandising system region is represented generally at 150. In the figure, a paved surface, i.e., a parking lot is represented in general at 152. The boundary of region 150 is defined by poles having a paved surface 152 to pole top height of, for example, ten feet as shown at 154–166. A dual or larger canopy similar to canopy 130 is represented generally at 168 and is formed in conjunction with poles 158–166 which extend ten feet above surface 152 and larger poles, for example, having a height from surface 152 of twelve feet as shown at 170 and 171. The top for the canopy 168 is represented by two slanting waterproof fabric components 174 and 175. Another canopy structured in a manner described in connection with canopies 74 and 74' is present within the merchandising region 150, however, as a demonstration of the modularity of the system at hand, the orientation of such canopy is changed as compared with FIG. 1. In this regard, the canopy is shown generally at 178, being supported from poles 161 and 162 in combination with poles of higher elevation, for example, twelve feet above surface 152 as shown at 180 and 181. Tensioned cable implemented horizontally disposed signage supports are shown in the figure. In this regard, tensioned cable assembly 183 extends between the tops of poles 154 and 155; tensioned cable assembly 184 extends between the tops of poles 155 and 156; tensioned cable assembly 185 extends between the tops of poles 156 and 157 and, tensioned cable assembly 186 extends between the tops of poles 157 and 158. In similar fashion, tensioned cable assembly 187 extends between the tops of poles 165 and 166; tensioned assembly cable 188 extends between the tops of poles 164 and 165; tensioned cable assembly 189 extends between the tops of poles 163 and 164; and tensioned cable assembly 190 extends between the tops of poles 162 and 163. As in the embodiments of FIG. 1, these tensioned cable assemblies function to support signage identifying and providing instructions corresponding with the merchandise within the intra-pole spacing defined merchandising bays. Exemplary palletized merchandise is shown in the figure. In this regard, palletized merchandise components 194–196 are positioned within the merchandising bay defined between poles 164 and 165. Merchandising components 198–203 are stocked within the merchandising bay represented between poles 163 and 164. Palletized merchandising components 206–208 are stocked within the merchandising bay defined between poles 162 and 163. On the opposite side of the boundary defined region 150, it may be observed that merchandising components 210–212 are stocked within the merchandising bay defined between poles 155 and 156; palletized merchandising component 213–221 are stocked within the merchandising bay defined between poles 156 and 157; and merchandising components 222–224 are stocked within the merchandising bay defined between poles 157 and 158. The figure further reveals the variations in the positioning of merchandise, for example, merchandising components 194–196, 206–208, 210–212, and 222–224 extend one pallet dimension into their associated merchandising bay. Correspondingly, components 198–201 extend two pallet dimensions into the retail region and merchandising components 213–221 extend three pallet dimensions into the area.

The implementation of FIG. 8 shows the important shopper aisle 226 extending between an importantly defined entrance represented at arrow 228 and an importantly defined exit represented at arrow 230. At the end of this shopper aisle 226 is cash/wrap station 232 incorporating a cash register counter 234 located beneath the canopy 178. Inasmuch as it is quite important that a shopper, once having selected certain merchandise not be caused to second guess the location of the cash/wrap station, canopy 178 functions to visually cue the shopper as to the location of this important retail function. A shopper, having selected certain merchandise from the aisle 226, will pause upon approaching cash/wrap station 232. Observation of the merchandise visually accented by the overhead canopy 168, will prompt the shopper in a manner fostering spontaneous purchases.

> If we went into stores only when we needed to buy something, and if once they're there we bought only what we needed, the economy would collapse, boom.
>
> Underhill (supra) p 31

It may be noted in FIG. 8 that the shopper aisle 226 is relatively narrower as compared with the corresponding aisle 120 described above.

The merchandising methodology of the invention is intended to provide, inter alia, the advantage of a modular system structuring permitting a wide variety of three dimensional merchandising regions or boundaries to be established. Of particular importance, these variations of merchandising region layout must be capable of being developed or erected using retail store personnel who generally will have no construction talent. Accordingly, a retailing region is determined by management on the parking lot or paved surface involved and a plurality of anchors then are professionally and permanently installed about and within the region. In this regard, a grid of anchors is established, certain ones of which may be elected for pole positioning and bay distance definition. The spacing between anchors in the grid may vary considerably. For example, for greater flexibility in layout, the anchor spacing may be relatively short, for example, about three and one half feet. Typically, however, the spacing is elected to provide anchor to anchor grid spacing of about ten to twenty feet, bay distances suited to lawn and garden merchandising. Once the anchors are established and permanently installed by professional construction organization, with accommodation for the necessary sloping of pavement, for example, for drainage purposes, then conventional store personnel, having the capability for readily and relatively rapidly configuring and installing the merchandising system components, may form the merchandising region.

Figure 9:
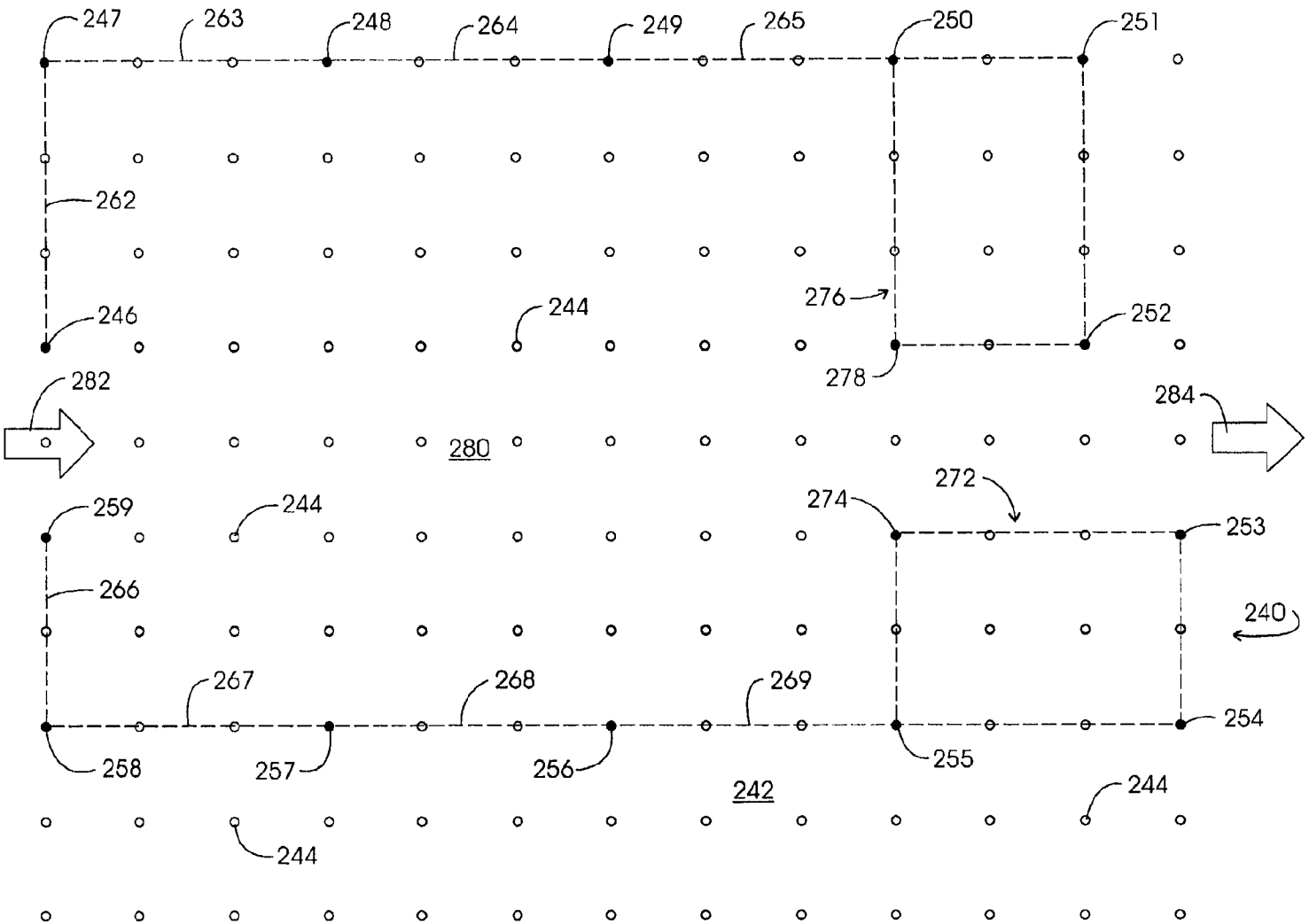
FIG. 9 is a top schematic view of an anchor grid layout which may be employed with the method of the invention and showing one merchandising geometric boundary.

FIG. 9 illustrates a relatively elaborate grid with short anchor-to-anchor spacing, for example, of about three and one half feet. Anchors not selected by the retailer for the purpose of supporting poles are represented as empty circles, certain of which are shown at 244. For the instant demonstration, the managing user has selected a retailing geometric boundary at the paved surface 242 which is defined by poles represented by solid anchor circles 246–259. The horizontally disposed signage supports or tensioned cable assemblies are represented at dashed line 262 extending between poles 246 and 247; dashed line 263 extending between poles 247 and 248; dashed line 264 extending between poles 248 and 249; dashed line 265 extending between poles 249 and 250; dashed line 266 extending between poles 258 and 259; dashed line 267 extending between poles 257 and 258; dashed line 268 extending between poles 256 and 257; and dashed line 269 extending between poles 255 and 256. A canopy represented in general at 272 is shown mounted upon poles 253–255 and pole 274 and a similar canopy represented generally at 276 is supported upon poles 250–252 and 278. Poles 253 and 274 of canopy 272 are of the earlier described longer variety extending, for example, twelve feet from the pavement surface 242, while corresponding canopy poles 250 and 278 are of that lengthier variety. A shopper aisle is established at 280 extending from an entrance region represented at arrow 282 and an exit region represented at arrow 284. One of the canopies 272 or 276 is elected as a cash/wrap station while the other, adjacent canopy may function in a manner described in connection with canopy 168 in FIG. 8.

Figure 10:
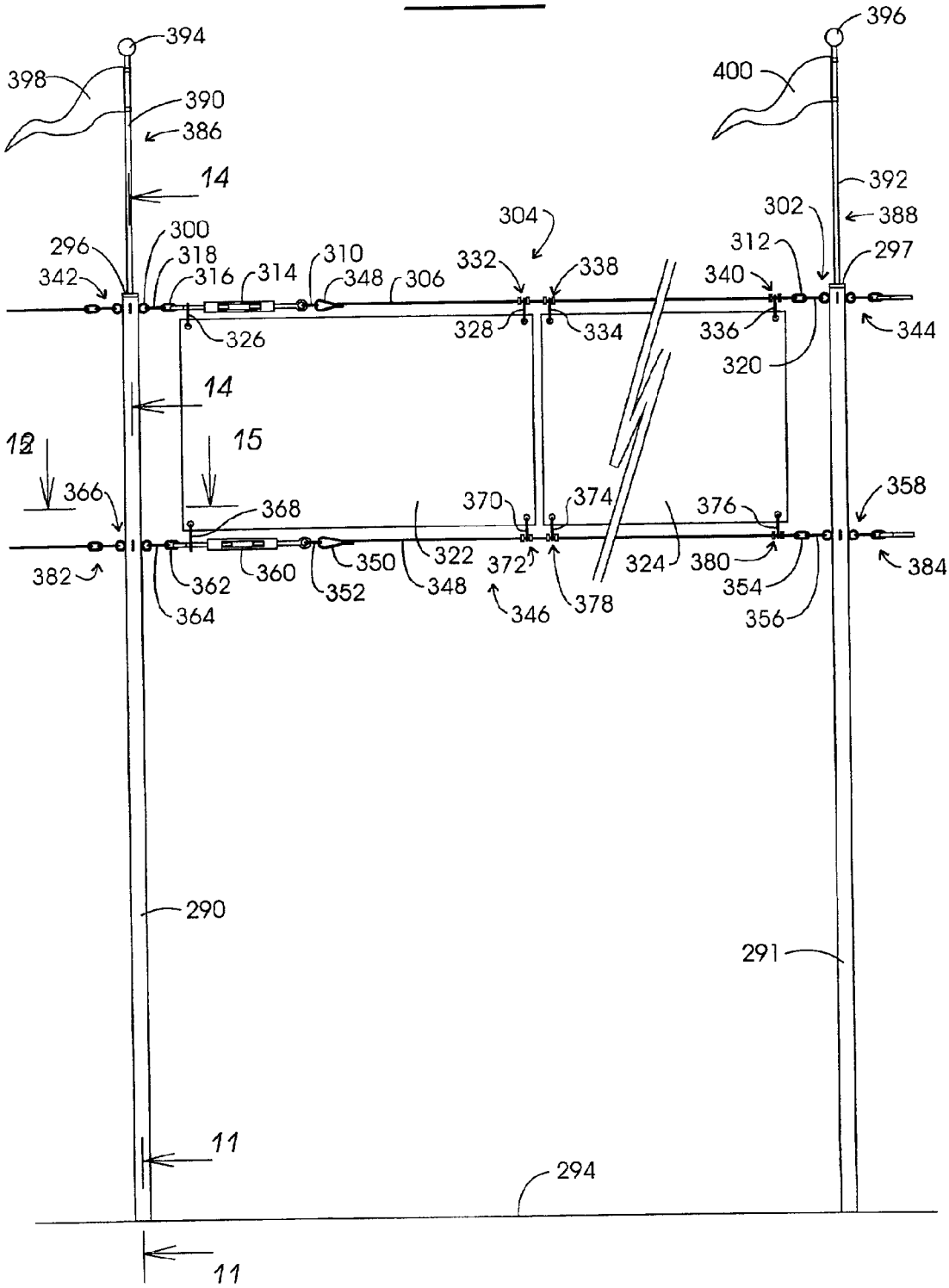
FIG. 10 is an enlarged side view of two spaced apart poles and associated signage employed with the method of the invention.

Turning now to the system structuring supporting the objectives of modularity and simplification of merchandising region erection and disassembly, reference initially is made to FIG. 10 wherein two poles illustrated at 290 and 291 are shown extending above pavement surface 294. Insertion ends of the poles 290 and 291 (see FIG. 11) extend a predetermined distance beneath the surface 294, such that they extend from the surface of pavement 294 to a top as shown respectively at 296 and 297. That distance to the tops 296 and 297 is arbitrarily defined herein as an overhead signage sight height, however, the sight lines from the eyes of a shopper will be to the signage suspended from the vicinity of the tops 296 and 297. Where that distance is at the lower value of ten feet and for the embodiment of the extended vertical signage described above at 106 and 106', then the top region will be configured with overhead top connector assemblies present as four steel eyelets arranged in quadrature. In this regard, three of these eyelets are shown extending from the top region of pole 290 as represented in general at 300. Correspondingly, three such eyelets are shown in general at the top region of pole 291 at 302. The horizontally disposed signage support is represented generally at 304 and, for purposes of simplicity for erection and disassembly, is implemented as a tensioned steel cable 306 which is prefabricated with a loop at each end, one of which is shown at 308, the loop in the opposite end not being seen. To facilitate assembly of the upper support assembly 304, chain replacement links as shown at 310 and 312 are interposed between cable 306 and the next component of the assemblage. The links 310 and 312 are marketed, for example, under the trade designation "Missing Link" by The Crosly Group, Inc. of Tulsa, Okla. Once connected with the cable 306 they cannot be removed. Chain replacement link 310 is connected to the eye of one threaded component end of a tension creating turnbuckle 314. The oppositely disposed threaded component eye of the turnbuckle 314 is coupled with a chain replacement link 316 which, in turn, is coupled with a spring activated snap clip 318. Clip 318 is coupled to an eyelet of the eyelet assemblage 300. The chain replacement link 312 at the opposite end of cables 306 is coupled with a similar snap clip 320 which, in turn, is connected to an eyelet of the eyelet grouping 302. Waterproof fabric signs as at 322 and 324 are suspended from the assembly 304 by connectors. In this regard, sign 322 is coupled with the assemblage 306 by connectors 326 and 328. Connector 328 is prevented from slidable movement along the assembly 304 by paired polymeric ties shown at 332. Connectors 326 is prevented from lateral sliding movement by virtue of the construction of turnbuckle 314 and its associated eyelet of the leftwardly shown threaded tightening component. In similar fashion, the signage represented at 324 is seen to be suspended by connectors 334 and 336 which extend about the cable 306 and are retained in position thereon by paired polymeric ties shown respectively at 338 and 340. Identical horizontally disposed signage supports are represented in general at 342 extending from an eyelet of the grouping 300 and at 344 extending from an eyelet of the grouping 302.

Extending in tension just below signs as at 322 and 324 is a horizontally disposed lower sign support or retainer assembly represented generally at 346 and structured identically as the upwardly disposed signage support 304. In this regard, the support 346 is formed with a steel cable 348 having looped ends, one of which is shown at 350. Those looped ends, in turn, are connected to chain replacement links. In this regard, loop 350 is shown connected to chain replacement link 352, while the opposite loop is coupled to chain replacement link 354. The latter link is connected through a snap clip 356 to an aligned eyelet of a four eyelet grouping represented in general at 358 and three of which are shown in the figure.

Looking to the opposite side of cable 348, replacement link 352 is seen coupled to the eyelet of one threaded connector of a turnbuckle 360, while the eyelet of the oppositely disposed threaded connector is coupled through a chain replacement link 362 to a snap clip 364. Clip 364, in turn, is coupled to one eyelet of four such eyelets arranged in quadrature and attached to pole 290 as represented generally at 366, three of the eyelets being revealed. Sign 322 is connected to the lower sign support or retainer 346 by two breakaway connectors 368 and 370. Connector 368 is restrained from lateral movement along the assembly 346 by virtue of its connection with the threaded component of turnbuckle 360 extending to the left as seen in the figure for reason given in connection with assemblage 304. However, paired polymeric ties as shown in general at 372 restrain connector 370 from lateral sliding movement upon cable 348. In similar fashion, breakaway connectors as illustrated, for example at 374 and 376 connect signs as at 324 with cable 348. Paired polymeric ties as shown respectively at 378 and 380 prevent lateral sliding movement of the connectors. Breakaway connectors are employed in connection with the lower sign support or retainer 346 to accommodate for excessive wind loads which would otherwise damage the signage. Lower signage support assemblies extend to other adjacent poles. A portion of one such assembly is shown at 382 extending to pole 290, while a corresponding lower sign assemblage is shown extending to pole 291 as represented in general at 384. While the height from pavement surface 294 to the top of the poles 290 and 291 and correspondingly, to the top region of the signage, has been designated as an "overhead signage sight height", correspondingly, the signage extends downwardly from the upper support within a shopper line of sight region to a bay access elevation above the surface 294 which may be represented as the elevation of the lower support or retainer assemblage 346. For the boundary identifying poles, that latter bay access elevation typically will be about eight feet, an elevation appropriate for providing access for moving forklift trucks within the defined bay region. In the latter regard, the distance between the bay defining poles as at 290 and 291 is referred to herein as a bay distance. Flag assemblies represented generally at 386 and 388 are mounted at the top of respective poles 290 and 291. In general, the flags will protrude about three and one half feet above the tops 296 and 297 of these respective poles. FIG. 10 shows that the flags are formed with an aluminum flag pole as at 390 in the case of flag assembly 386, and 392 in the case of flag assembly 388. The poles 390 and 392 terminate in respective finials 394 and 396 and are seen to support pennant-shaped flags shown respectively at 398 and 400. Preferably, flags 398 and 400 are formed with a long chain synthetic polymeric amid having the generic designation, nylon. Cables as at 306 and 348 are formed of galvanized aircraft cable of ⅛ inch diameter which has been coated with a clear vinyl to provide a 3⁄16 inch outer diameter.

As indicated above, while the poles, cables, signage, canopies and the like have been designed such that they may be erected and disassembled by relatively untrained store personnel, the anchor structures formed downwardly from the pavement surface are professionally permanently installed. These permanent anchor structures are arranged in a geometric grid, for example, as described in conjunction with FIG. 9 and their dimensioning will vary depending upon anticipated wind loads. The anchor installations also take account of variations in pavement surface elevation. Such variations are essentially always encountered, inasmuch as they are required for water runoff control. By accommodating for such elevational variations in conjunction with the permanent anchors, store personnel are not required to carry out any leveling procedure, for example, by pole length selection. In general, the anchors are initially formed by drilling an eighteen inch diameter foundation hole. The anchor foundation is formed with concrete which, depending upon anticipated wind loads, may require steel bar reinforcement. However, within the concrete foundation there is located a vertically disposed sleeve.

Looking to FIG. 11, pavement surface 294 reappears in conjunction with a representation of the concrete foundation, portions of which are revealed at 410. Rigidly mounted within the concrete foundation 410 is a vertically disposed cylindrical steel sleeve 412 having an annulus shaped sleeve top 414 and extending vertically downwardly to an engagement surface defining bottom plate 416. Additionally formed within the concrete foundation 410 is a generally rectangularly shaped inset or depression below surface 294 as shown at 418. Such depression typically has a depth of about four inches. Note that the sleeve top falls below surface 294 and within the depression 418. Extending horizontally from the top 414 of sleeve 412 is one flange 420 of a steel angle iron 422. The opposite flange of angle iron 422 is welded to sleeve 412 and a steel nut 424 is welded to the bottom of the horizontal flange adjacent a bolt receiving bore 426. Pole 290 is seen to have been inserted within the sleeve 412 to the extent that its insertion end 428 is in abutment with the engagement surface top of bottom plate 416. The elevation of sleeve 412 extending from top 414 to the upwardly disposed surface of bottom plate 416 is adjusted for each anchor foundation to accommodate for pavement surface grade variations. However, the sleeve support distance is fixed and established for each installation with respect to anticipated wind loads. By accommodating for wind loads and grade variations for each given installation, the advantage of a uniform or common pole height for both establishing bay widths and with respect to the enhanced elevational poles, for example, extending twelve feet above the pavement surface remain uniform.

Following the insertion of the poles as at 290 within sleeves as at 412 to the extent that the insertion ends 428 contact the upper surface of bottom plates 416, store personnel then simply bolt the poles as at 290 to the sleeve as at 412. This is carried out by virtue of a previous welding of a steel angle iron as at 430 to each pole at a position with respect to top 414 of sleeve 412 such that abutment of insertion end 428 with the top surface of bottom plate 416 is assured. For this purpose, the horizontal flange 432 of angle iron 430 will be spaced slightly above the surface of sleeve top 414. Flange 432 also is bored at 434 to receive a bolt 436 which threadably engages stationary nut 424.

Poles as at 290 and additionally, the poles of enhanced elevation utilized with the canopy structuring of elevated signage as described at 100–102 in FIG. 1, preferably are formed with schedule 80 steel having an outside diameter of two and three eighths inches. The corresponding internal diameter of the sleeves as at 412 is two and one half inches.

For 70 mph exposure C wind loads which are typical of California or 80 mph exposure B wind loads typical of the Northwest portion of the United States, for a concrete foundation having an eighteen inch diameter, a depth of four feet, three inches generally is called for with a support length below grade of three feet. For these conditions, the concrete foundation as at 410 is reinforced with steel cylinder cage configured reinforcement bars having four vertical components with horizontal ties at twelve inches on center and two additional ties at the top region. An alternate foundation for these conditions will be twenty four inches in diameter and three feet, eighth inches in depth.

For 90 mph exposure C wind loads which are typical of approximately 85% of potential site locations in the United States, an anchor foundation diameter of eighteen inches and depth of five feet one inch with a three foot below grade sleeve support is called for particularly with the poles of enhanced height of twelve feet above grade. For this condition, the use of a reinforced steel cylinder cage again is called for with four vertical components and horizontal ties at twelve inches on center with two additional ties at the top. An alternate foundation with a twenty four inch diameter will be four feet, four inches in depth.

For 70 mph exposure B wind loads, an anchor foundation with a hole diameter of eighteen inches will have a depth of three feet, six inches and the sleeve support will be three feet below grade. For this application a reinforced steel cylinder cage with four vertical components and horizontal ties at twelve inches on center with two additional ties at the top is called for. An alternate foundation for this situation will be a twenty four inch diameter anchor foundation hole which is three feet in depth.

A more pleasing appearance is given to the merchandising region at hand where the poles are coated with a colored material, either a thermoplastic coating or a powder coating. Typical of such coatings is polyester, made under the trade designation "Spraylat" by Spraylat Corporation of Gainesville, Tex.

Inasmuch as a substantial utilization of the instant methodology will be seasonal, it is desirable that at the end of a given season, the merchandising region components be removed and stored until a next ensuing lawn and garden season or holiday interval. However, as part of this periodic removal procedure it is necessary to secure the anchors during these intervals of nonuse. This is carried out by the positioning of a cylindrical cap over the sleeve top 414, the uppermost surface of which falls just below the pavement surface elevation 294. Such an arrangement provides, for instance, clearance for snowplowing during winter seasons.

Figure 13:
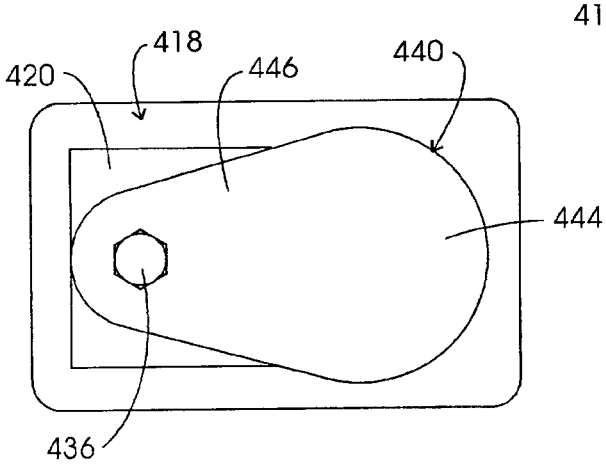
FIG. 13 is a partial top view of the structure shown in FIG. 12.
Figure 12:
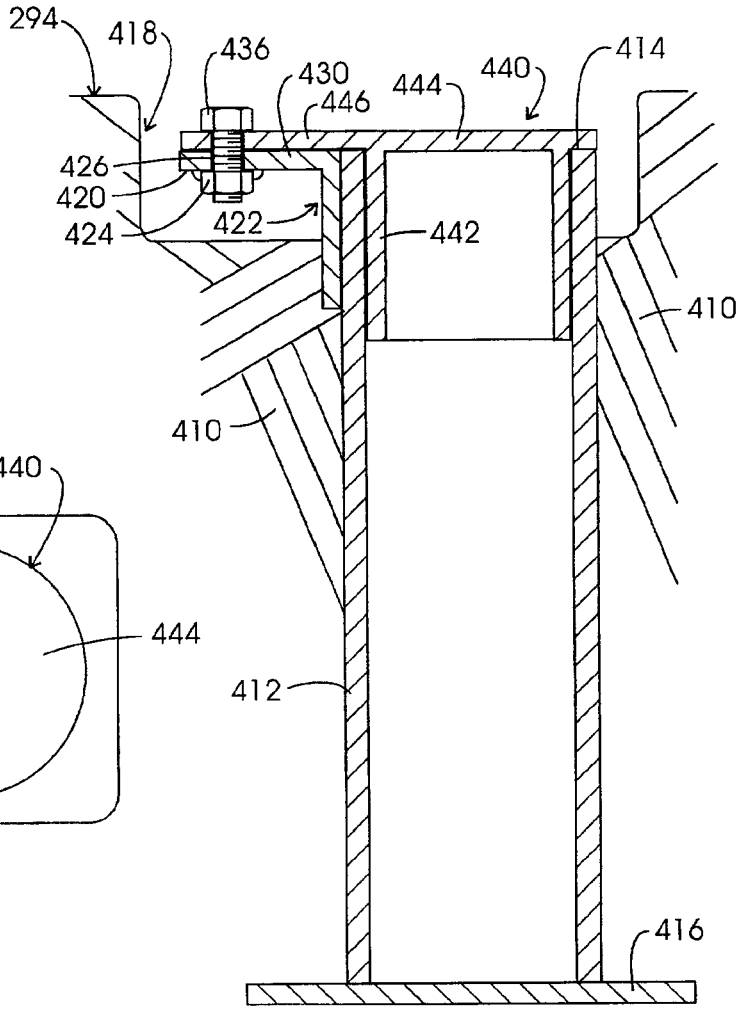
FIG. 12 is a view of the component shown in FIG. 11 with the removal of a pole and installation of a cap.

Referring to FIGS. 12 and 13, a cap is shown generally at 440 having a cylindrical insertion component 442 which slidably nests within the sleeve 412. Cap 440 additionally includes a steel top cover 444 having a connection portion 446 which extends over the upper surface of flange 420 of the sleeve angle iron 422. Bolt 436 secures the cap in place by virtue of its threaded engagement with the stationary nut 424 attached to the bottom of flange 420. Note that the cap 440 and bolt 436 exhibit an upper surface region which falls below the pavement surface elevation 294 as it extends with portions of the anchor foundation 410. Accordingly, no hindrance to pavement snow plowing is posed by the grid of anchors. Typically, the depth of the insert 418 is about four inches below grade. Of course the anchors within a given grid which are not utilized during the active merchandising season also will be capped as shown and described.

Now looking to the installation of the flag assemblies, reference is made to FIG. 14 showing the mounting of flag assembly 386 upon pole 290. The figure reveals that the pole 296 is configured with a cylindrical top cap 450 welded thereto. Cap 450 is formed with a central cylindrical opening 452 within which is inserted and welded a cylindrical steel flag receiving sleeve or socket 454 which extends downwardly from its sleeve top 456 a flag support distance to a bottom plate 458. In this bottom region of the flag sleeve 454, an annulus shaped steel spacer 460 is provided to achieve a rigid securement of sleeve 454. Aluminum flag pole 390 is seen to be inserted within the flag sleeve 454 to the extent that its flag insertion end 462 is in abutment with the top surface of bottom plate 458. Note that the sleeve 454 extends above the top surface of cap 450 to its sleeve top 456. This slight extension permits the provision of a bore 464 through the sleeve 456. An additional bore 466 extends through the flag pole 390 and, when appropriately aligned, a steel securement pin 468 is inserted therethrough to retain the flag assemblage 386 in position. In general, a minimum flag support distance derived with sleeve 545 is twelve inches.

Figure 15:
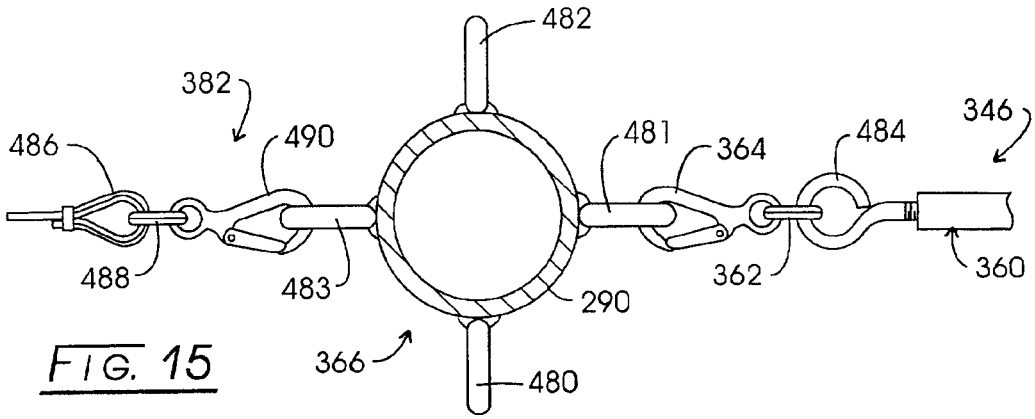
FIG. 15 is a partial sectional view taken through the plane 15—15 shown in FIG. 10.

As discussed in connection with FIG. 10, connection of the upper and lower horizontal signage supports to the poles is made available by fabricating the pole with an upper and lower grouping of four eyelets. The support assemblages then simply are attached to the eyelets with snap clips by store personnel and the turnbuckles are tightened to an extent putting the associated cables in tension but not to an extent causing a flexure of the poles. Four eyelets are provided in the interest of modularity. Looking to FIG. 15, the eyelet grouping 366 is revealed with a higher level of detail as including four eyelets 480–483. The figure also reveals that threaded eyelet containing component 484 of turnbuckle 360 is attached by chain replacement link 362 to the snap clip 364. The latter snap clip 364 is seen coupled to eyelet 481. The support assemblage 382 is seen to be coupled to oppositely disposed eyelet 483. In this regard, a cable end 486 is coupled with a chain replacement link 488 to a snap clip 490. Snap clip 490 is seen to have been attached to eyelet 483.

Typically, the signage employed with the merchandising methodology is fabricated with a polystyrene-based thin, flexible material. To facilitate its easy suspension from the horizontal support assemblies, a variety of suspending components are available to the user.

Figure 16:
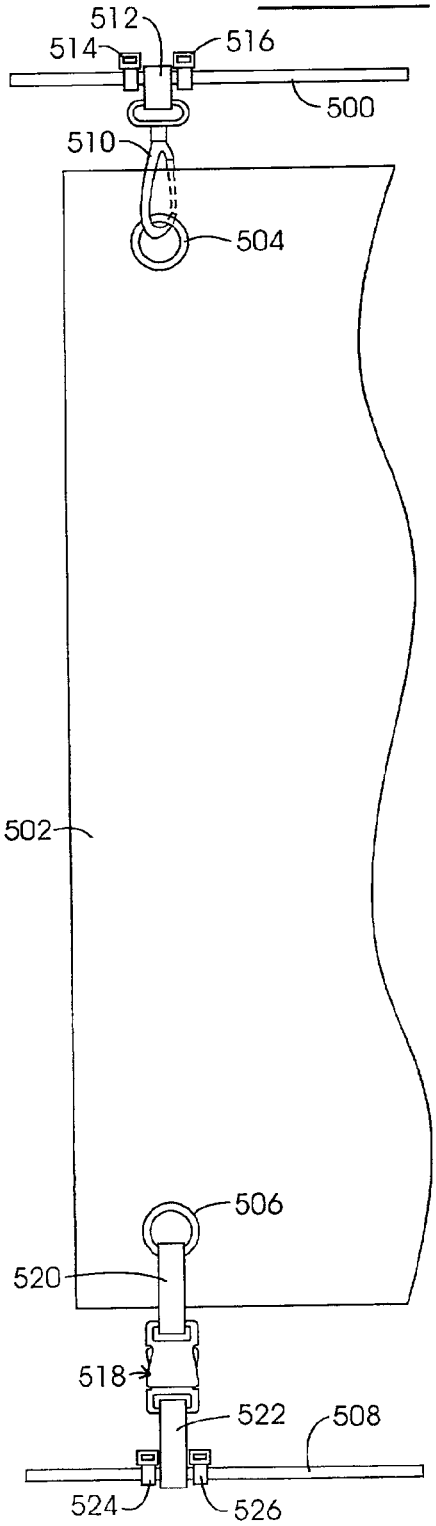
FIG. 16 is a partial front view of cabling and signage employed with the method of the invention showing connector embodiments.

Referring to FIG. 16, one such arrangement is portrayed. In the figure, the cable component of an upper sign suspension assembly is shown at 500. A sign 502 having suspension and retention grommets as seen respectively at 504 and 506 is suspended from cable 500 and retained against wind diversion by the tensioned cable 508 of a lower horizontal retention assembly. For the instant embodiment, grommet 504 is coupled to the cable 500 by a two and one fourth inch snap hook 510. Hook 510, in turn, is coupled to the cable 500 by a polymeric tie 512. Two smaller polymeric ties 514 and 516 secure the components 510 and 512 from sliding over the cable 500. Snap hook 510 may be fabricated of nylon or Acetal, a carbon-based resin and is marketed by the Homalocks, Division of Homa Industries, Inc. of Danburry Conn. The lower portion of sign 502 is coupled via grommet 506 to cable 508 with a three eighths inch breakaway clip 518. Clip 518 is formed of the above-noted Acetal material and is marketed by Homalocks Division of Homa Industries, Inc. (supra). Attachment of the clip 518 to grommet 506 is by polymeric tie 520 and corresponding attachment to cable 508 is by polymeric tie 522. The latter component is restrained from slidable movement from cable 508 by polymeric ties 524 and 526.

Figure 17:
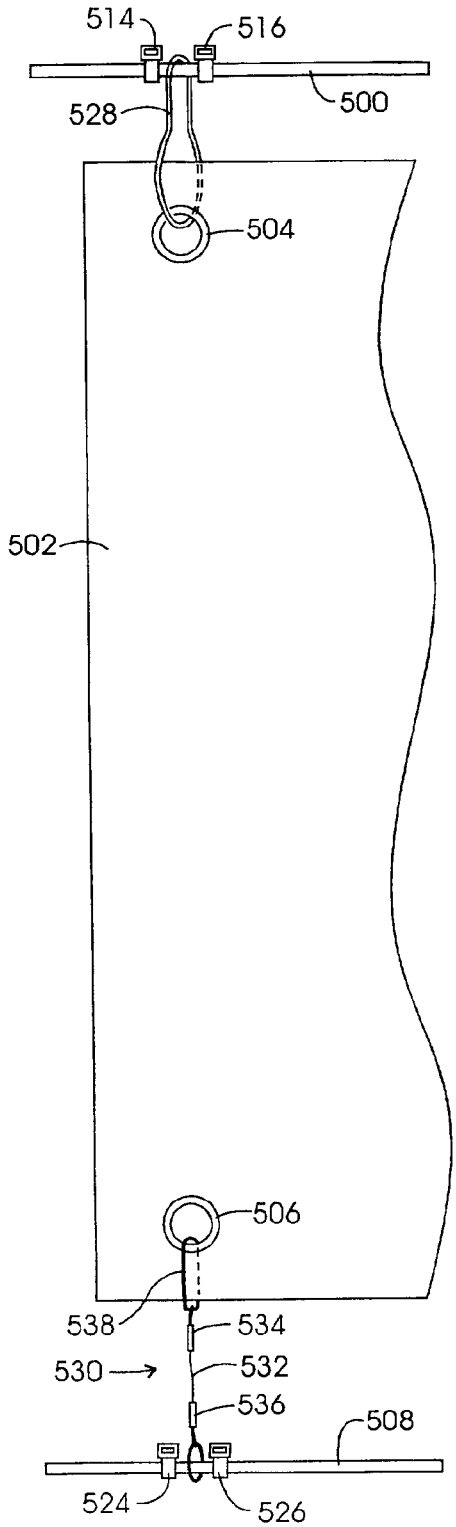
FIG. 17 is a partial front view of cabling and signage employed with the method of the invention showing connector embodiments.

An alternate approach for a suspending signage using more generally available material is illustrated in connection with FIG. 17. In that figure, sign 502 reappears in conjunction with tensioned cables 500 and 508. Grommet 504 is coupled to cable 500 by a chrome plated steel connector 528 configured as a conventional shower curtain hanger. A breakaway connector is shown generally at 530 coupling grommet 506 with cable 508. Connector 530 is configured with a length of twelve pound test fishing leader 532 coupled to oppositely disposed fishing swivel connectors 534 and 536. Connector 534 is coupled by a tie 538 to grommet 506.

Because of a somewhat heavier fabric and relatively higher wind load associated with the canopy configurations, their underlying support components necessarily are structurally more robust but retain the aspect of modularity.

Figure 18:
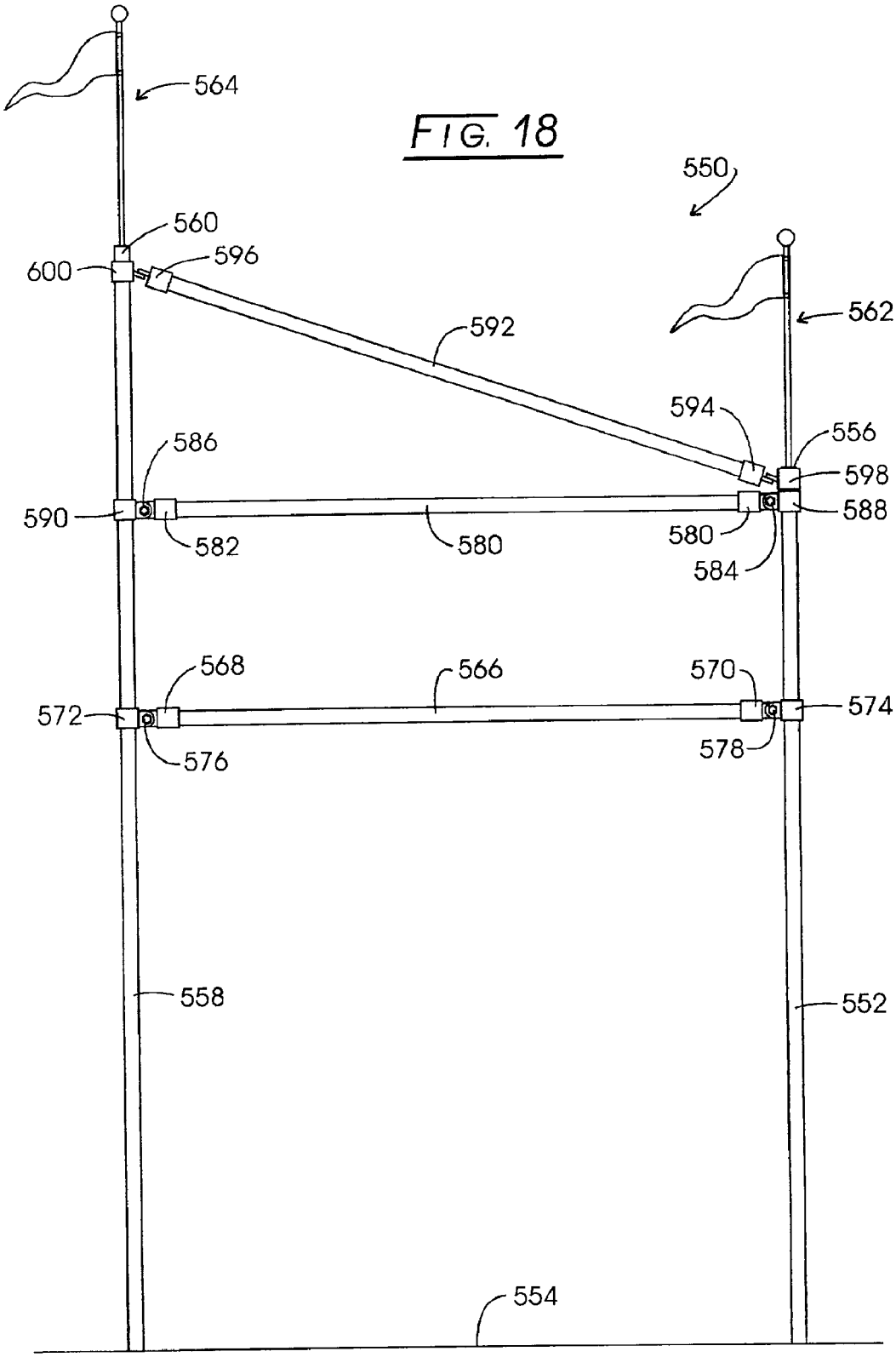
FIG. 18 is a side view of a canopy frame constructed in accordance with the invention.

Referring to FIG. 18, a side view of the frame structuring for a canopy is revealed in general at 550. The frame 550 is configured with a pole 552 which extends from an anchor (not shown) below pavement surface 554 to a top 556. That height about the surface 554 typically is ten feet. The canopy further is configured with a pole of enhanced height 558 which is supported by an anchor located below surface 554 and extends from that surface to a top 560 representing an elevation of, for example, twelve feet from surface 554. A flag assembly shown generally at 562 extends from the top 556 of pole 552 and a flag assembly shown generally at 564 extends from the top 560 of pole 558. To form the side structure of the canopy frame 550, three rigid steel struts are utilized. In this regard, a lower horizontal strut 566 having flanged cap connectors 568 and 570 at its ends are bolted to corresponding respective cuff members 572 and 574. These cuff members 572 and 574 extend around and are attached to respective poles 558 and 552. Connection between the flange cap connectors 568 and 570 with respective cuff members 572 and 574 is by bolts as at 576 and 578. Strut 566 is located in elevational terms at the noted bay exit elevation which is about eight feet from surface 554. Next, an upper strut 580 is provided at the elevation of the horizontally disposed signage support, i.e., about ten feet from surface 554. Configured identically with strut 566, strut 580 extends to oppositely disposed flanged cap connectors 580 and 582 which, in turn, are connected by respective bolts 584 and 586 to cuff members 588 and 590. Cuff members 588 and 590 are attached to respective poles 552 and 558. The roof slope of the canopy established by the frame 550 is emulated by side strut 592. Strut 592 extends between flanged cap connectors 594 and 596 which, in turn, are bolted to respective cuff members 598 and 600. Note that cuff member 598 is coupled to top region 556 of pole 552, while cuff member 600 is coupled to the top region 560 of pole 558. The opposite side of the canopy frame is identically structured.

Figure 19:
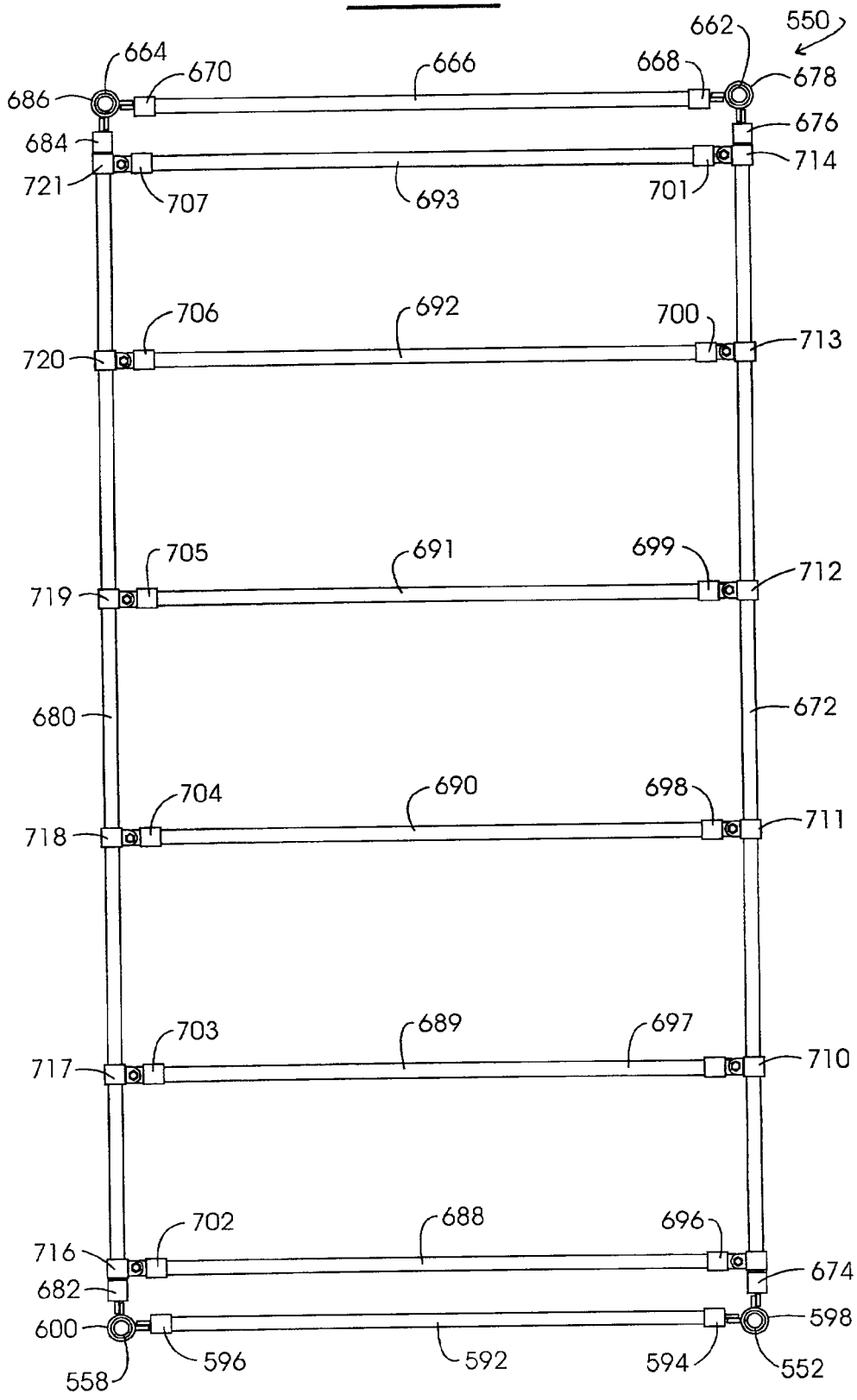
FIG. 19 is a top view of the frame shown in FIG. 18.

Looking to FIG. 19, a top view of the structure 550 is revealed. In the figure, poles 552 and 558 reappear in conjunction with side strut 592. Spaced a canopy length from those poles are corresponding identical poles shown respectively at 662 and 664. An upper side strut 666 extends between flanged cap connector 668 and 670 and is configured and attached in identical fashion as strut 592. Connected between the tops of pole 552 and 662 is a steel beam strut 662, the ends of which are connected with flange cap connectors 664 and 666. Cap connector 674 is coupled to flange containing cuff member 598 at pole 552 and to a cuff member 678 which also is connected to cap member 668. In similar fashion, a beam strut 680 extends between the tops of poles 558 and 664. In this regard, the ends of beam strut 680 are coupled with flanged cap connectors 682 and 684. Connector 682 is coupled to cuff member 600 at pole 558, while connector 684 is coupled to a cuff member 686 which also is connected to cap connector 670 and strut 666. Extending between beam strut 680 and beam strut 672 is a sequence of mutually spaced apart rafter struts 688–693 which are configured identically, extending between respective flanged cap connectors 696–701 adjacent beam strut 672 and respective flanged cap connectors 702–707 adjacent beam strut 680. Flanged cap connectors 696–701 are connected with beam strut 672 by respective cuff members 710–714, while respective cap connector 702–707 are connected with the beam strut 680 through respective cuff members 716–707. Not shown in the drawing are struts supporting side panels, for instance, as described at 86 and 87 in FIG. 1. In that figure, the panels, as at 86–88 may be formed, for example, with a 100% solution dyed acrillic produced under the trade designation "Sunbrella" by Glen Raven Mills, Inc., of Glen Raven, N.C. The material forming the roof 78 may be provided, for example, as a coated fabric, for example, a fabric made with type 1100 DTXPESHT yarn having a weight of seventeen ounces per square yard and marketed under the trade designation "Ferrari" by Astrup Corporation of Cleveland Ohio.

Since certain changes may be made in the above method and system without departing from the scope of the invention herein involved, it is intended that all matter contained in the above description or shown in the accompanying drawings shall be interpreted as illustrative and not in a limiting sense.

What is claimed is:

1. The method for presenting merchandise having given trade dress at an outdoor paved surface, comprising the steps of:

defining a retailing geometric boundary at said paved surface;

providing a plurality of anchors about said boundary, each extending below said surface and mutually spaced apart to establish bay distances, each said anchor having a vertically disposed sleeve having a support distance located below said paved surface;

providing a plurality of first poles, each having an insertion end configured for slideable insertion to the extent of said support distance within a said sleeve and extensible, when inserted within a said sleeve, an overhead signage sight height from said surface to a top;

positioning said first poles within said anchor sleeves to define a retail floor pattern having an entrance region and a shopper aisle extending therefrom to a shopper exit region;

interconnecting a said pole top with a next adjacent said pole top with a horizontally disposed signage support to define a three-dimensional retailing region with a select number of merchandising bays extending between adjacent said poles from at least a portion of said geometric boundary to said shopper aisle;

suspending merchandise information signage from said signage support at said boundary along said bays;

said signage extending downwardly from said signage support within a shopper line of sight region to a lower border adjacent a bay access elevation above said surface;

positioning said merchandise within said bay below said bay access elevation and locating said merchandise in correspondence with said merchandise information signage; and providing a cash/wrap region adjacent said shopper aisle.

2. The method of claim 1 including the steps of:

providing flag support structures at said top of said poles;

providing a plurality of flag assemblies; and positioning said flag assemblies within said flag support structures.

3. The method of claim 2 in which said plurality flag assemblies are provided as pennants formed with nylon.

4. The method of claim 1 including the steps of:

providing a canopy; and mounting said canopy with said poles at said cash/wrap region.

5. The method of claim 1 in which said step of suspending merchandise information signage establishes said bay access elevation as about eight feet.

6. The method of claim 1 in which said step for providing said poles with a said overhead signage sight height provides said sight height within a range of between about 10 feet and 12 feet.

7. The method of claim 2 in which said step for providing said anchors, provides said mutual spacing within a range from about 3 feet to about 20 feet.

8. The method of claim 1 including the steps of:

providing a plurality of covers each being extensible over a said anchor sleeve adjacent said surface; and attaching a said cover over each said sleeve when not engaged with a said pole.

9. The method of claim 1 in which said step for positioning said poles defines said retail floor pattern as having a said entrance region, a said shopper aisle and a said exit region with widths of about 10 feet.

10. The method of claim 1 in which said step for interconnecting each said pole top with the next adjacent pole top is carried out with a tensioned cable assembly as said horizontally disposed signage support.

11. The method of claim 1 including the steps of:

providing a horizontally disposed lower signage support interconnecting a said pole with said next adjacent pole at about said bay access elevation; and coupling said horizontally disposed lower signage support with said signage adjacent said lower border.

12. The method of claim 11 in which said step of coupling said horizontally disposed signage support is carried out with break-away couplers configured to break in response to the assertion of a predetermined wind load upon said signage.

13. The method of claim 12 in which said step of providing said horizontally disposed lower signage support is carried out by providing a tensioned cable assembly.

14. The method of claim 1 including the steps of:

providing two said anchors adjacent said boundary mutually spaced apart a banner width distance;

providing two second poles each having an insertion end configured for slideable insertion to the extent of said support distance within a said sleeve of one of said two anchors, said second poles being extensible when inserted within a said sleeve, a second pole height from said surface to a second pole top greater than said overhead signage sight height;

providing an upper banner support assembly extensible between said two second poles;

removably horizontally coupling said upper banner support assembly between said two second poles adjacent said second pole tops; and suspending a remotely viewable banner from said upper banner support.

15. The method of claim 14 in which said step for providing two said anchors adjacent said boundary locates said two anchors adjacent said entrance region.

16. The method of claim 1 in which said step for providing a plurality of anchors provides said sleeves as each having a base plate at an elevation with respect to said paved surface selected to effect a linear alignment of said first pole tops.

17. The method of claim 1 in which:

said step for providing a plurality of anchors provides said anchors in regularly spaced relationship defining a geometric grid; and said step for defining a retailing boundary defines said boundary by selecting anchors with said geometric grid.

18. A system for presenting merchandise at an outdoor paved surface, comprising:

a plurality of anchors fixed beneath said surface in a geometric pattern within a retail region boundary, at least two of said anchors being mutually spaced apart a bay distance, each said anchor including a vertically disposed sleeve having a support distance located below said surface and extending to an engagement surface;

a plurality of first poles of first height, each having a first top and an insertion end slidably inserted in supporting relationship within a select said anchor sleeve to an extent wherein said insertion end is in freely abuttable contact with said sleeve engagement surface, said first poles being inserted within said anchors in mutually spaced adjacency to define a merchandising region exhibiting an entrance region, a shopper aisle and an exit region, said pole first height establishing an overhead signage sight height from said surface to said first top;

an overhead top connector assembly fixed to each said first pole adjacent said first top.

a plurality of upper signage support assemblies removably coupled with said overhead top connecter assemblies to define a boundary of said merchandising region including said entrance region;

a plurality of merchandise information carrying signs suspended from select said upper signage support assemblies and extending downwardly therefrom to a lower border to define a shopper line of sight region;

a retainer connection assembly fixed to each said first pole at a location defining a bay access elevation above said surface when said first poles are inserted within said sleeves;

a plurality of lower signage retainer assemblies removably coupled between retainer connector assemblies of adjacent said first poles in parallel relationship with said upper signage support assemblies; and a plurality of lower couplers removably connected between said lower signage retainer assemblies and said lower border of said signs.

19. The system of claim 18 in which each said upper signage support assembly comprises:

an elongate cable;

a cable tensioner coupled with said cable; and two spaced apart spring actuated couplers manually connectable with said overhead top connector assemblies.

20. The system of claim 18 in which each said lower signage retainer assembly comprises:

an elongate cable;

a cable tensioner coupled with said cable; and two spaced apart spring actuated couplers manually connectable with said retainer connector assemblies.

21. The system of claim 18 in which said lower couplers are configured to break away in response to the assertion of predetermined wind loads at said signs.

22. The system of claim 18 in which each said sleeve engagement surface is at an elevation with respect to said paved surface selected to effect a linear alignment of said first pole tops.

23. The system of claim 18 in which:

two said anchors are spaced apart a banner width and located adjacent said entrance region;

two second poles, each having an insertion end slideably inserted in a sleeve of one of said two anchors to an extent wherein said insertion end is in freely abuttable contact with said sleeve engagement surface, said second poles extending a second pole height from said paved surface to a second top greater than said first height;

an upper banner connector assembly fixed to each said second pole adjacent said second top;

an upper banner support assembly removably coupled with said two second poles at said upper banner connector assembly thereof; and a banner removably coupled with said upper banner support assembly and extending downwardly therefrom to a lower banner edge.

24. The system of claim 23 further comprising:

a lower banner connector assembly fixed to each said second poles adjacent said lower banner edge;

a banner retainer assembly removably coupled between said second poles at the lower banner connector assembly thereof; and at least two said lower couplers removably connected between said banner retainer assembly and said lower banner edge.

25. The system of claim 24 in which said two lower couplers are configured to break away in response to the assertion of a predetermined wind load at said banner.

26. The system of claim 23 in which each said sleeve engagement surface of said two anchors is at an elevation with respect to said paved surface selected to affect a common elevation of said second pole second tops.

* * * * *